US010320050B2

(12) United States Patent
Park

(10) Patent No.: US 10,320,050 B2
(45) Date of Patent: Jun. 11, 2019

(54) MULTI-MODE RESONATOR

(71) Applicant: KMW INC., Hwaseong-si (KR)

(72) Inventor: Nam-Shin Park, Hwaseong-si (KR)

(73) Assignee: KMW INC., Hwaseong-si (KR)

( * ) Notice: Subject to any disclaimer, the term of this patent is extended or adjusted under 35 U.S.C. 154(b) by 0 days.

(21) Appl. No.: 16/164,806

(22) Filed: Oct. 19, 2018

(65) Prior Publication Data

US 2019/0051965 A1 Feb. 14, 2019

Related U.S. Application Data

(63) Continuation of application No. 15/488,350, filed on Apr. 14, 2017, now Pat. No. 10,109,905, which is a continuation of application No. PCT/KR2015/010593, filed on Oct. 7, 2015.

(30) Foreign Application Priority Data

Oct. 17, 2014 (KR) ..... 10-2014-0140751

(51) Int. Cl.

| | |
|---|---|
| ***H01P 7/06*** | (2006.01) |
| ***H01P 1/205*** | (2006.01) |
| ***H01P 1/208*** | (2006.01) |

(52) U.S. Cl.

CPC ..... *H01P 7/06* (2013.01); *H01P 1/2053* (2013.01); *H01P 1/2082* (2013.01)

(58) Field of Classification Search

CPC .... H01P 7/06; H01P 7/105; H01P 7/10; H01P 1/2082; H01P 1/2084

USPC ..... 333/202, 219, 219.1, 227

See application file for complete search history.

(56) References Cited

U.S. PATENT DOCUMENTS

| | | | |
|---|---|---|---|
| 3,562,677 | A | 2/1971 | Gunderson |
| 5,794,784 | A | 8/1998 | Murphy |
| 5,914,037 | A | 6/1999 | Yen |
| 2004/0130412 | A1 | 7/2004 | Yamakawa |
| 2014/0293528 | A1 | 10/2014 | Ohishi et al. |

FOREIGN PATENT DOCUMENTS

| | | | |
|---|---|---|---|
| EP | 0632518 | A1 | 1/1995 |
| JP | 2001-085908 | A | 3/2001 |
| JP | 2014-045389 | A | 3/2014 |
| KR | 10-2004-100084 | A | 12/2004 |
| KR | 10-2006-0043849 | A | 5/2006 |
| KR | 10-2010-0104679 | A | 9/2010 |

OTHER PUBLICATIONS

International Search Report for PCT/KR2015/010593, dated Feb. 19, 2016, and English Translation thereof.

(Continued)

*Primary Examiner* — Stephen E. Jones

(57) ABSTRACT

A multi-mode resonator includes: a housing having a cavity therein; and a plurality of resonance ribs which are arranged radially around a center of the cavity with a predetermined interval therebetween. Each of the plurality of resonance ribs includes a body having a lower end and an upper end. The lower end of each of the plurality of resonance ribs is fixed to a bottom surface of the housing, and the body of the each of the plurality of resonance ribs is bent so that the upper end of each of the plurality of resonance ribs points to the center of the cavity.

20 Claims, 30 Drawing Sheets

(56) References Cited

OTHER PUBLICATIONS

Eric J. Naglich et al. "Intersecting Parallel-Plate Waveguide Loaded Cavities for Dual-Mode and Dual-Band Filters", IEEE Transcations on Microwave Theory and Techniques, pp. 1829-1838, vol. 61, No. 5, May 2013.

Huan Wang et al., "An Inline Coaxial Quasi-Elliptic Filter With Controllable Mixed Electric and Magnetic Coupling", IEEE Transactions on Microwave Theory and Techniques, pp. 667-673, vol. 57, No. 3, Mar. 2009.

Xuguang Wang, "Compact Quad-Mode Bandpass Filter Using Modified Coaxial Cavity Resonator With Improved Q-Factor", IEEE Transcations on Microwave Theory and Techniques, pp. 965-975, vol. 63, No. 3, Mar. 2015.

Notice of Allowance dated Jun. 21, 2018 for U.S. Appl. No. 15/488,350 and list of references.

Notice of Allowance dated Jul. 6, 2018 for U.S. Appl. No. 15/488,350 and list of references.

(a)

(b)

(a)

(b)

(a)

(b)

(a)

(b)

(a)

(b)

MULTI-MODE RESONATOR

CROSS REFERENCE TO RELATED APPLICATIONS

This application is a continuation of U.S. application Ser. No. 15/488,350, filed on Apr. 14, 2017, which is a continuation of International Application No. PCT/KR2015/010593 filed on Oct. 7, 2015, which claims priority to Korean Application No. 10-2014-0140751 filed on Oct. 17, 2014, which applications are incorporated herein by reference.

TECHNICAL FIELD

The present disclosure relates to a resonator configured to implement a radio frequency (RF) filter, and more particularly, to a multi-mode resonator that outputs resonant frequencies in multiple resonant modes.

BACKGROUND ART

A radio frequency (RF) device such as an RF filter is typically configured using a connection structure of multiple resonators. Such a resonator is a circuit element that resonates at a specific frequency based on a combination of an inductor L and a capacitor C as an equivalent electronic circuit, and each resonator is structured such that a dielectric resonance (DR) element or metallic resonance element is installed inside a cavity such as a metallic cylinder or rectangle, etc., surrounded by a conductor. Thus, each resonator allows existence of only an electromagnetic field of a unique frequency in a processing frequency band in the cavity, enabling microwave resonance. Generally, the resonator has a multi-stage structure including sequentially connected multiple resonance stages, each of which is formed for multiple cavities.

FIG. 1 illustrates an example of a conventional 6-pole bandpass filter 10. Referring to FIG. 1, in the conventional example, the bandpass filter 10 includes a housing 110 having, for example, six cavities sectioned by a predetermined interval or space inside hexahedral metal, and in each cavity, six dielectric or metallic resonance element 122 having high quality factor (Q) values are fixed using a support. Input and output connectors 111 and 113 mounted on a side of the housing 110 and a cover 160 for shielding an open surface of the housing 110 are also provided in the bandpass filter 10. Each cavity of the housing 110 is sectioned by a partition 130 having predetermined-size windows 131 through 135 formed therein to adjust the amount of coupling between resonators, and an inner surface of the housing 110 is silver-plated to stabilize electric performance and to maximize conductivity. A coupling screw 175 that is insertable into the windows 131-135 through the cover 160 or the housing 110 is also provided for fine adjustment of the amount of coupling.

Each resonance element 122 is supported by the support provided erect on a bottom surface, and a tuning screw 170 for tuning a frequency is installed above each resonance element 122 in such a way to be inserted into the cavity through the cover 160 and thus, fine adjustment of a resonant frequency may be possible by frequency tuning with the tuning screw 170.

On a side of the housing 110 are provided the input and output connectors 111 and 113 which are connected to input and output feeding lines (not shown), respectively, in which the input feeding line delivers a signal input from the input connector to a resonance element on the first stage and the output feeding line delivers a signal input from a resonance element on the last stage to the output connector.

An example of an RF filter having the above-described structure is disclosed in a Korean Patent Laid-Open Gazette No. 10-2004-100084 (entitled "Radio Frequency Filter", published on Dec. 20, 2004, and invented by Jongkyu Park, Sangsik Park, and Seuntaek Chung) filed by the present applicant.

However, in the conventional bandpass filter (or band rejection filter), to construct a filter having multiple poles, a coupling means for coupling multiple cavities with each resonance element 122 is inevitably needed. That is, in the conventional filter, one resonance element 122 implements only a single resonance mode, and thus to implement a multi-mode filter, a structure in which multiple resonators are connected is required. As a result, a significantly large space is needed for implementation of the multi-mode filter, increasing the size, weight, and manufacturing cost of the filter.

As such, a filter having a multi-mode resonator structure is one of communication facilities that occupy large spaces, and research has been steadily and actively performed to reduce the size and weight of the filter. Moreover, in line with a recent trend where each base station has evolved into a small (or micro) cell to respond to high processing speed and improved quality in the recent mobile communication market, the small size and light weight of the filter are required more crucially.

SUMMARY

Accordingly, the present disclosure provides a multi-mode resonator capable of interconnecting multiple identical-mode resonant frequencies.

The present disclosure also provides a small-size multi-mode resonator.

The present disclosure also provides a light-weight multi-mode resonator.

The present disclosure also provides a multi-mode resonator contributing to manufacturing cost reduction.

The present disclosure also provides a multi-mode resonator allowing simple and efficient frequency tuning.

To achieve the foregoing objects, there is provided a multi-mode resonator including a housing provided with a cavity corresponding to a substantially single accommodation space and a plurality of resonance ribs which are arranged with a predetermined interval therebetween in the cavity, have lower ends fixed to a bottom surface of the housing, and have upper ends facing each other to generate a resonant signal based on multiple or complex coupling therebetween.

The plurality of resonance ribs may have a bar shape that is globally bent in an arch shape, and a cross-sectional shape of the plurality of resonance ribs may be substantially circular.

At least a part of the upper ends of the plurality of resonance ribs may be cut.

The lower ends of the plurality of resonance ribs may be globally integrally connected by a single connecting auxiliary support having a ring shape.

The lower ends of the plurality of resonance ribs may be connected globally integrally with the housing in such a way to extend from a lower end surface of the housing.

BRIEF DESCRIPTION OF THE DRAWINGS

The above and other aspects, features, and advantages of the present invention will be more apparent from the following detailed description taken in conjunction with the accompanying drawings, in which.

DETAILED DESCRIPTION

Hereinafter, exemplary embodiments of the present invention will be described in detail with reference to the accompanying drawings. In the following description, specific details such as detailed elements, etc., will be provided, but they are merely provided to help the overall understanding of the present disclosure and it would be obvious to those of ordinary skill in the art that modifications or changes may be made to the specific details within the scope of the present disclosure.

The present disclosure proposes a multi-resonance-mode filter that provides multiple resonance modes. Conventionally, it is general that to provide, for example, four resonance modes, four cavities and one resonance element in each of the cavities are required. However, the multi-resonance-mode filter according to the present disclosure may provide four resonance modes (quadruple modes) or five resonance modes (quintuple modes) in one cavity.

Figure 1:
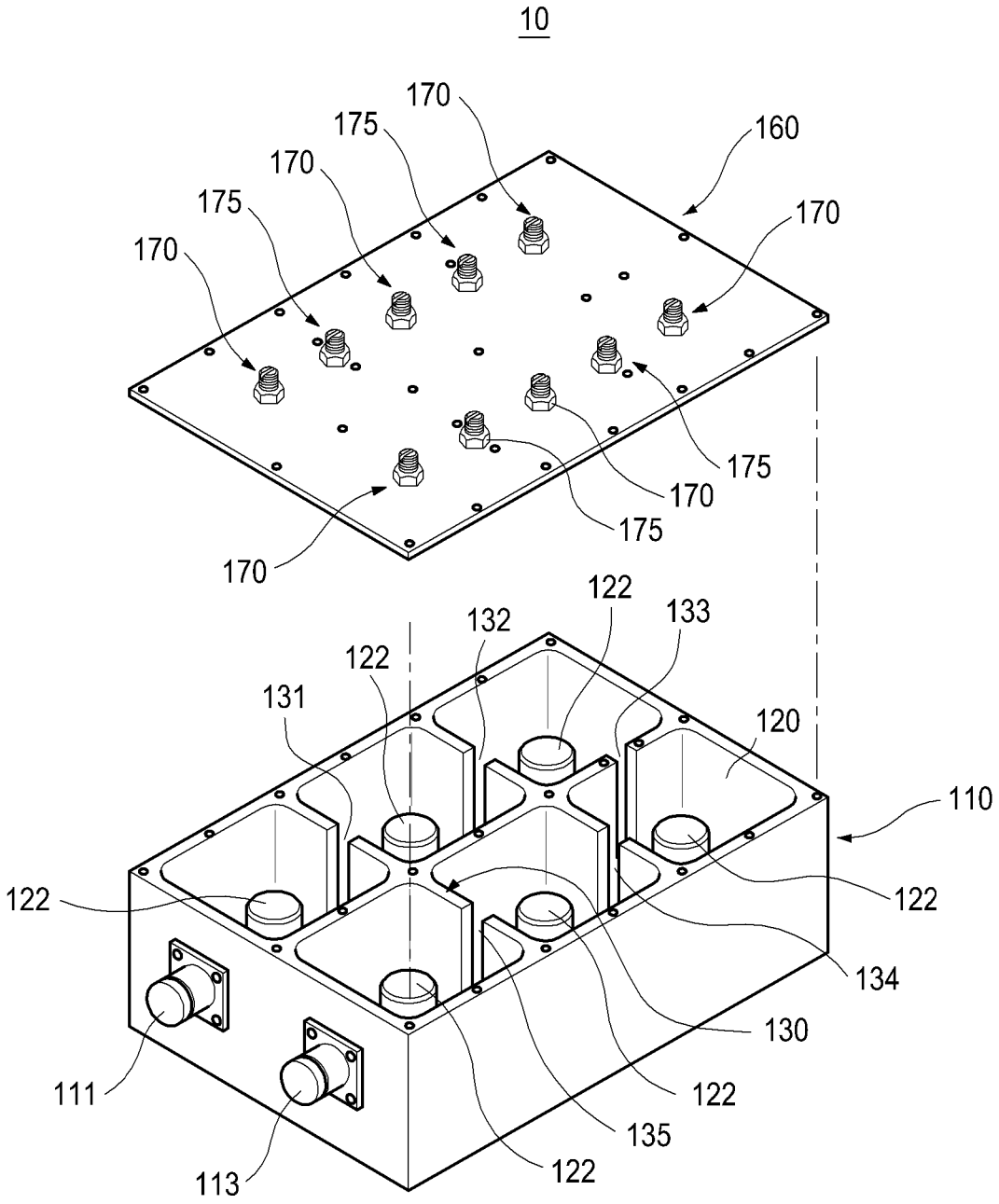
FIG. 1 is a partial exploded perspective view of an example of a conventional 6-pole bandpass filter.
Figure 2A:
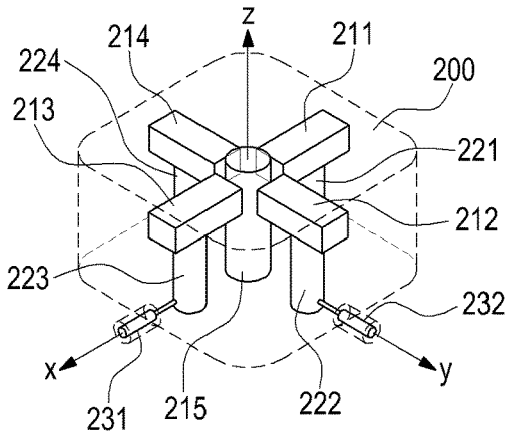
FIGS. 2A through 2C are structural diagrams of a multi-mode resonator corresponding to a bandpass filter according to a first embodiment of the present disclosure.
Figure 2B:
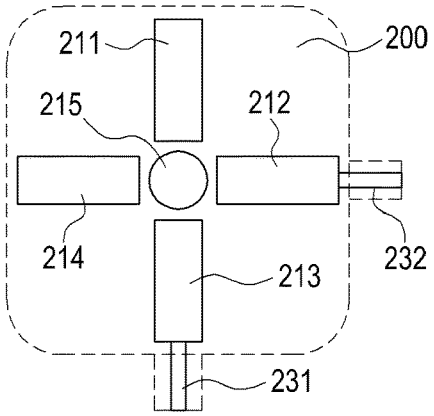
Figure 2C:
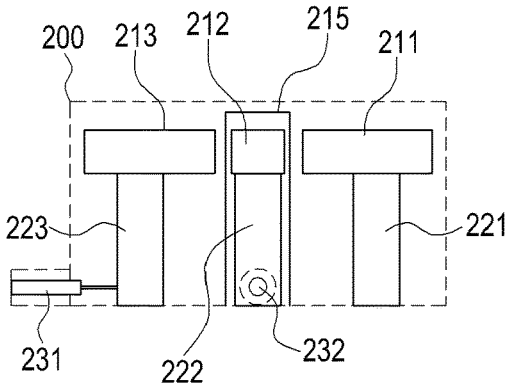

FIGS. 2A through 2C are structural diagrams of a multi-mode resonator corresponding to a bandpass filter according to a first embodiment of the present disclosure, in which FIG. 2A illustrates a perspective projection structure of a portion (a resonance rod portion), FIG. 2B illustrates a top plan structure, and FIG. 2C illustrates a side structure. The resonator illustrated in FIGS. 2A through 2C may include a cavity 200 having a space formed by a metallic housing (bottom cover) like a typical filter structure, and FIGS. 2A through 2C do not show a structure of the metallic housing, input and output connectors formed on an outer portion of the housing, etc., for convenience of a description.

Referring to FIGS. 2A through 2C, the multi-mode resonator according to the first embodiment of the present disclosure may include the cavity 200 in the shape of a rectangular box or in a shape similar thereto, which has a substantially single accommodation space inside a housing (not shown). However, such a structure of the cavity 200 may have various shapes such as a polyprism, a cylinder, and so forth, as well as the rectangular box.

In the cavity 200 are provided a plurality of resonance arms arranged with a predetermined interval or space therebetween. The plurality of resonance arms may be made of a metallic material, and may be arranged with an equal interval therebetween. In this case, the plurality of resonance arms are paired such that one ends of the paired resonance arms face each other and the paired resonance arms may be arranged to cross each other. More specifically, as in the first embodiment illustrated in FIGS. 2A through 2C, in the cavity 200, for example, resonance arms adjacent to each other are orthogonal to each other, and four resonance arms 211, 212, 213, and 214 are individually installed in such a way to be separated from each other. The four resonance arms 211 through 214, that is, first through fourth resonance arms 211 through 214, are arranged globally (planarly) in the shape of '+', that is, a center of the entire arrangement structure of the four resonance arms 211 through 214 corresponds to a center of the cavity 200. Each of the four resonance arms 211 through 214 has the shape of a rectangular parallelepiped bar that is longitudinally long. The four resonance arms 211 through 214 are fixedly installed by first through fourth resonance legs 221, 222, 223, and 224 which extend from (or are fixedly installed on) a bottom surface of the cavity 200 (an inner lower end surface of the housing), and are formed of, for example, a metallic material, in a cylindrical shape.

The first through fourth resonance legs 221 through 224 may be manufactured integrally with the lower end surface of the housing, for example, through die-casting, when the lower end surface of the housing forming the cavity 200 is formed, or may be individually manufactured and fixedly attached to the lower end surface of the housing through welding, soldering, screw-coupling, and so forth. Likewise, the first through fourth resonance arms 211 through 214 may be manufactured integrally with the first through fourth resonance legs 221 through 224 when the first through fourth resonance legs 221 through 224 are formed, or may be individually manufactured and fixedly attached to the first through fourth resonance legs 221 through 224, respectively.

In the first embodiment illustrated in FIGS. 2A through 2C, a resonance rod 215 having a structure similar to a resonance element of a conventional filter structure is further installed in the center of the entire arrangement structure of the four resonance arms 211 through 214, that is, in the center of the cavity 200. The four resonance arms 211 through 214 and the resonance rod 215 are installed physically spaced apart from each other with a proper distance therebetween, such that signals therebetween may be complexly coupled with each other. The amount of signal coupling is adjusted based on adjustment of the distance. In such an entire structure of the four resonance arms 211 through 214, the four resonance arms 211 through 214 are complexly coupled with each other, unlike in the structure of the conventional resonator that provides sequential coupling.

If the arrangement structure of the four resonance arms 211 through 214 and the resonance rod 215 is substituted into three axes, for example, x, y, and z axes, which are orthogonal to each other around the center of the cavity 200, then the first resonance arm 211 and the third resonance arm 213 may be on the x axis, the second resonance arm 212 and the fourth resonance arm 214 may be on the y axis, and the resonance rod 215 may be on the z axis.

Meanwhile, an input connector (not shown) and an output connector (not shown) may be formed on one pole of the x axis and one pole of the y axis, respectively, and an input probe 231 for connection with the input connector formed on one pole of the x axis and an output probe 232 for connection with the output connector formed on one pole of the y axis are provided, and the input probe 231 and the output probe 232 exchange input and output signals with one pair of resonance arms among the plurality of resonance arms 211 through 214. In an example of FIG. 2, the input probe 231 and the output probe 232 are directly or indirectly connected with the third resonance leg 223 and the second resonance leg 222, respectively, to deliver the input and output signals, thus exchanging the input and output signals with the third resonance arm 213 and the second resonance arm 212.

Figure 3A:
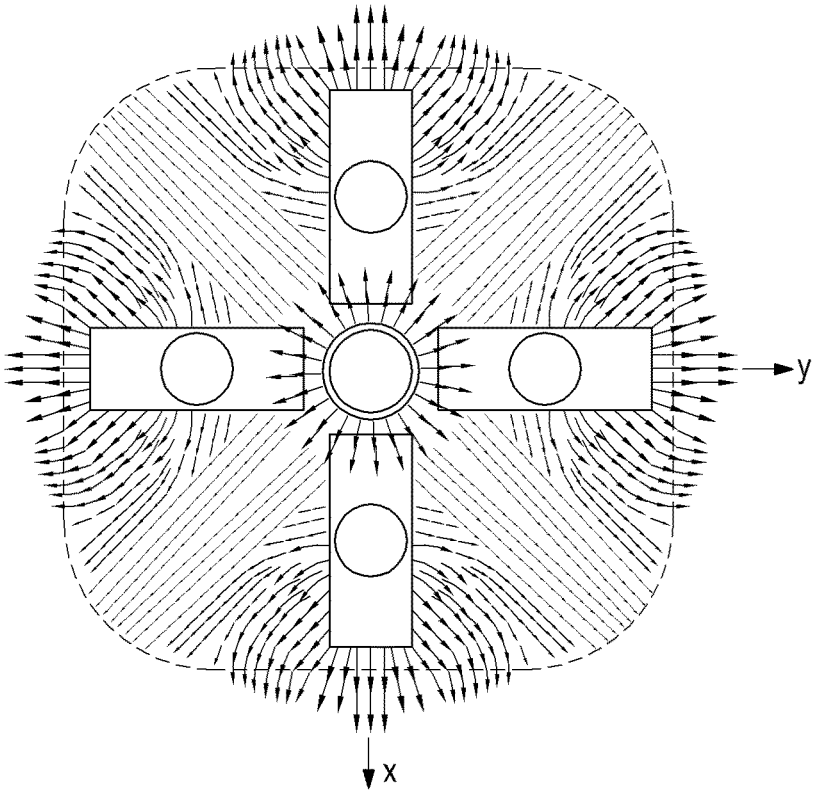
FIGS. 3A through 3E illustrate multi-mode resonance characteristics of the multi-mode resonator corresponding to the bandpass filter according to the first embodiment of the present disclosure.
Figure 3A:
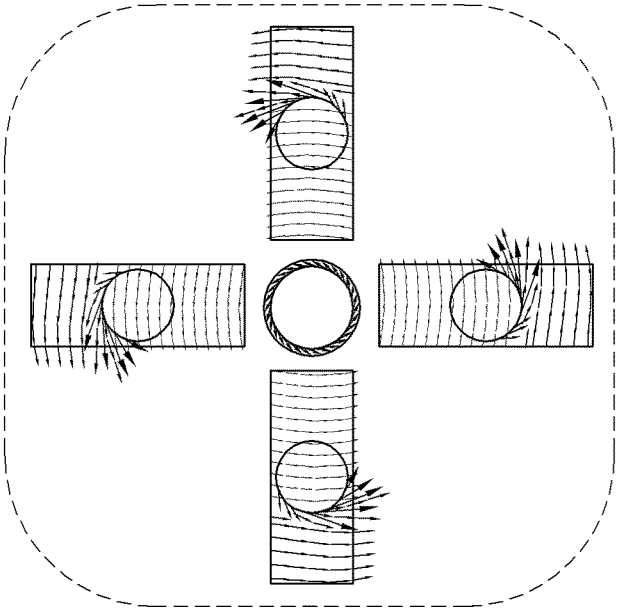
Figure 3B:
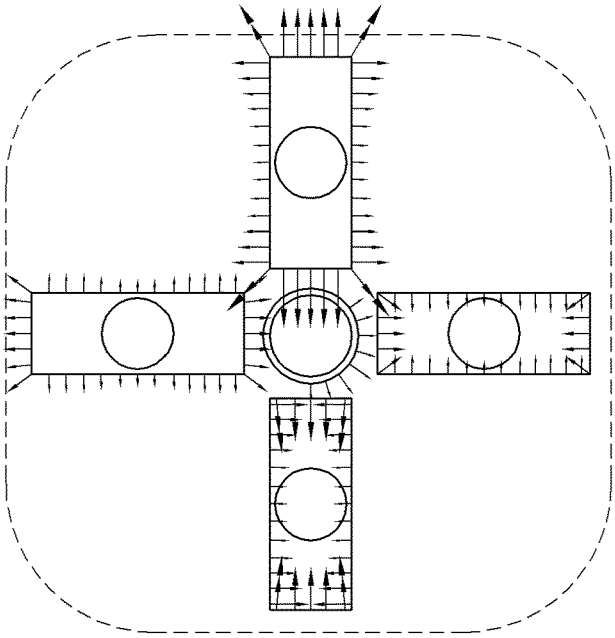
Figure 3B:
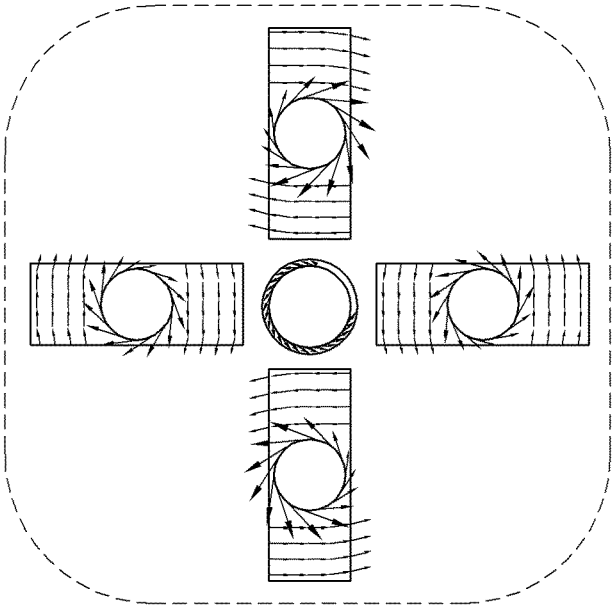
Figure 3C:
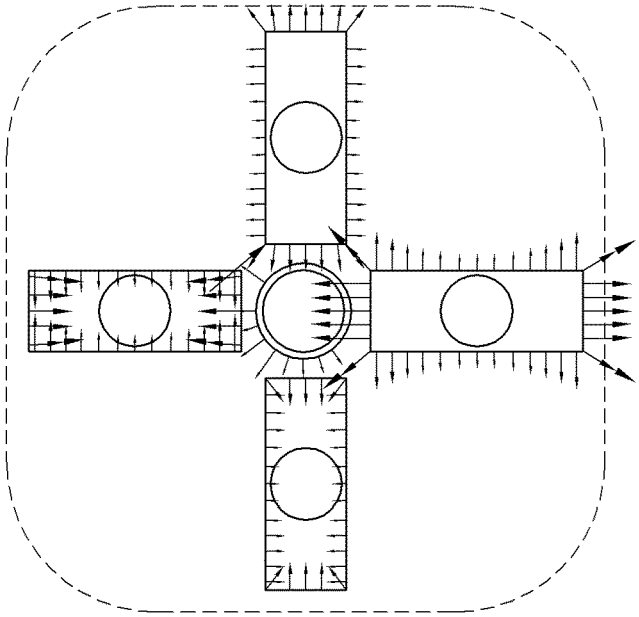
Figure 3C:
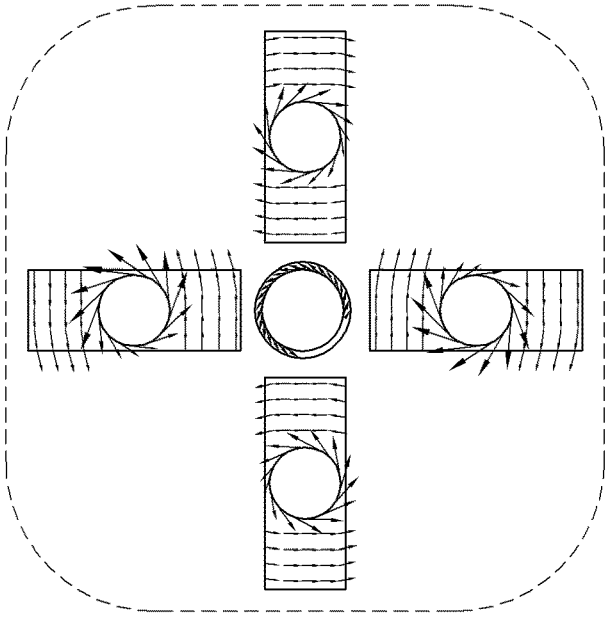
Figure 3D:
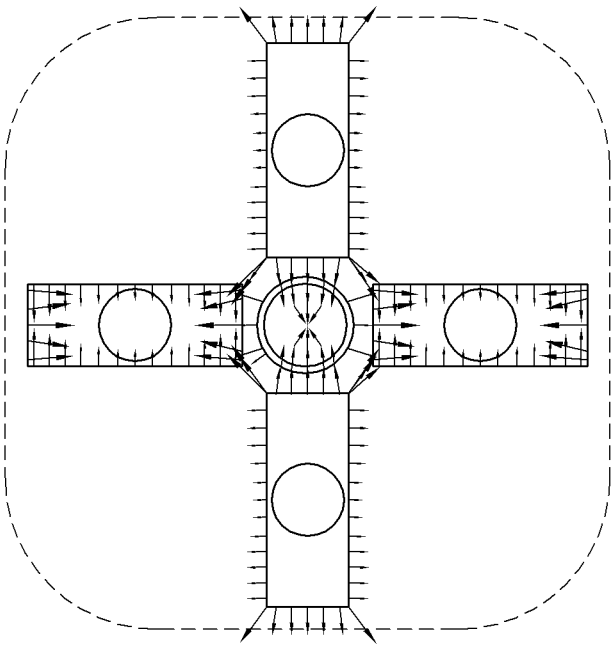
Figure 3D:
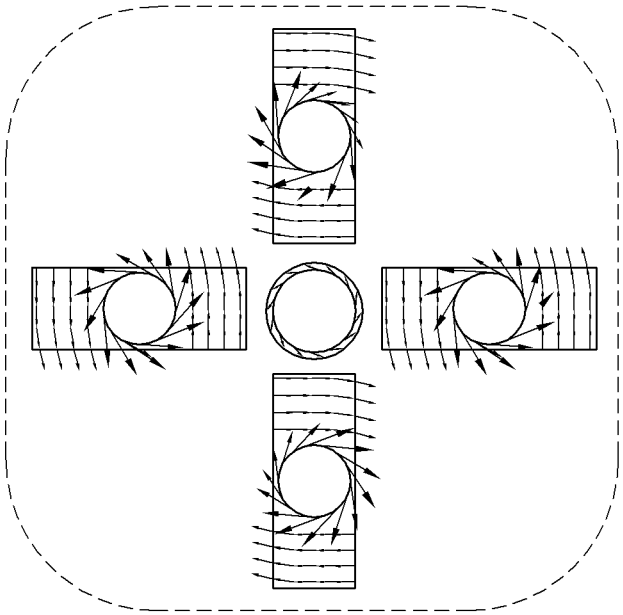
Figure 3E:
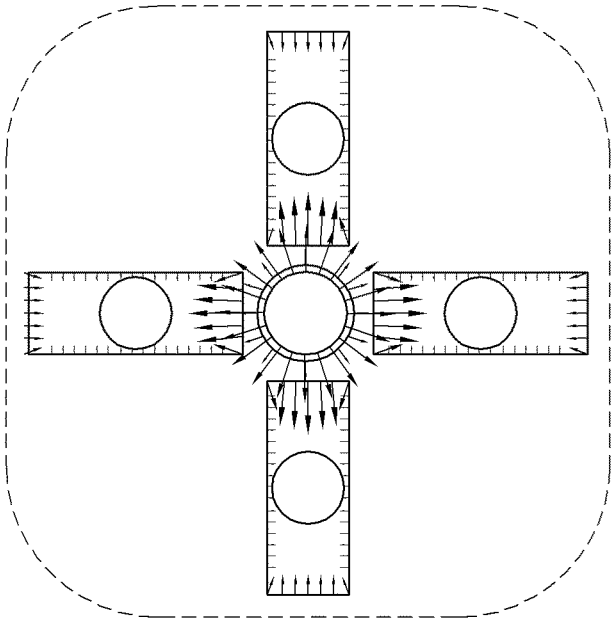
Figure 3E:
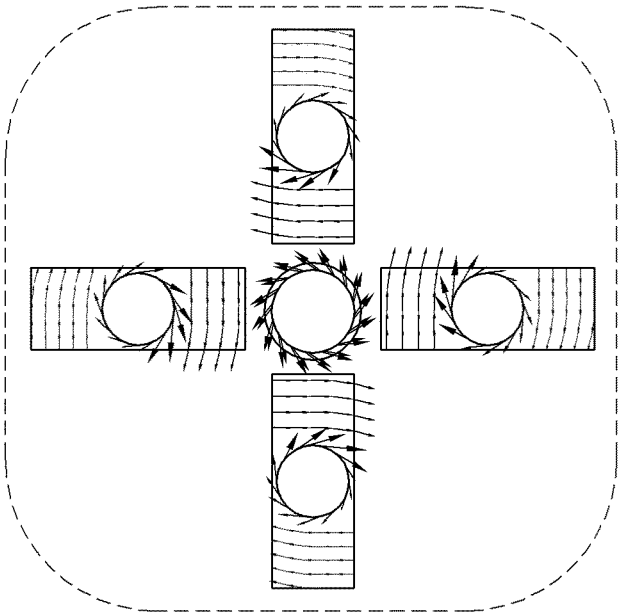

Multi-mode resonance characteristics of the resonator structured as described above are shown in FIGS. 3A through 3E. FIG. 3A illustrates a magnetic field (or an electric field) of a first resonance mode formed by a total combination (coupling) of a resonance structure, FIG. 3B illustrates a magnetic field (or an electric field) of a second resonance mode where dominant resonance is formed along the y axis, for example, by the second resonance arm 212 and the fourth resonance arm 214, FIG. 3C illustrates a magnetic field (or an electric field) of a third resonance mode where dominant resonance is formed along the x axis, for example, by the first resonance arm 211 and the third resonance arm 213, FIG. 3D illustrates a magnetic field (or an electric field) of a fourth resonance mode formed by a total combination of the first through fourth resonance arms 211 through 214, and FIG. 3E illustrates a magnetic field (or an electric field) of a fifth resonance mode where dominant resonance is formed along the z axis, for example, by the resonance rod 215. In each of FIGS. 3A through 3E, (a) shows E-field characteristics and (b) shows H-field characteristics.

Figure 4:
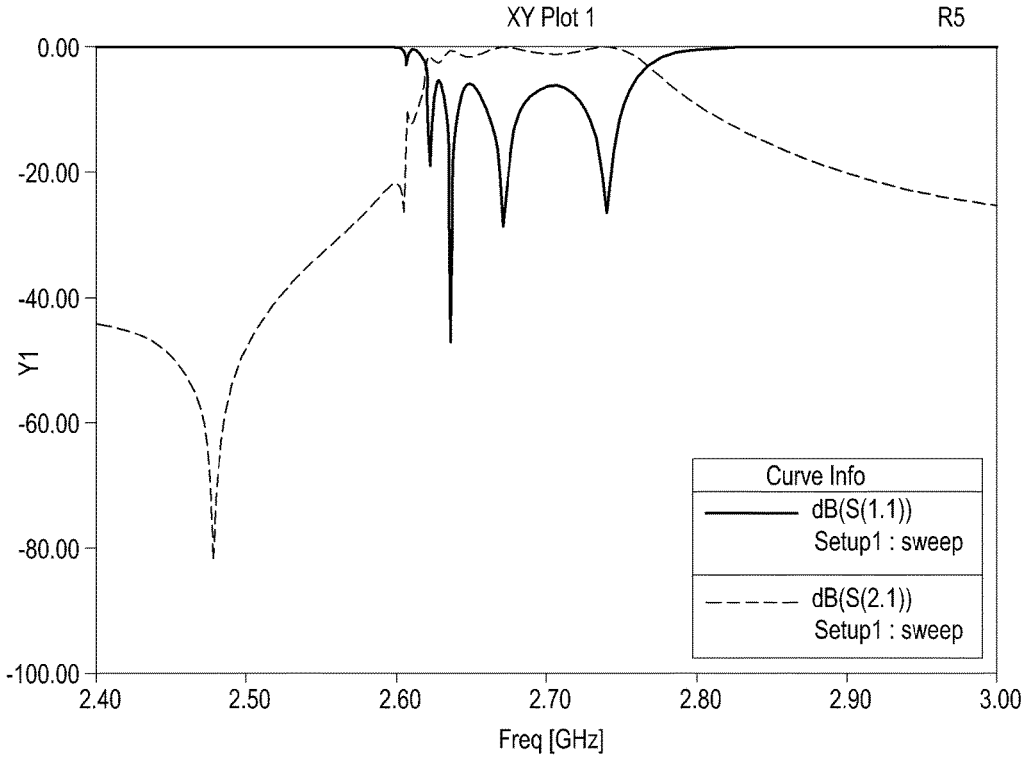
FIG. 4 is a graph showing frequency filtering characteristics of the multi-mode resonator corresponding to the bandpass filter according to the first embodiment of the present disclosure.

FIG. 4 is a graph showing frequency filtering characteristics of the multi-mode resonator illustrated in FIGS. 2A through 2C. Referring to FIG. 4, it can be seen that frequency filtering characteristics vary with five multi-mode characteristics shown in FIGS. 3A through 3E.

As such, the multi-mode resonator according to the first embodiment of the present disclosure implements the five resonance modes in one cavity 200, and in this case, the multi-mode resonator structured according to the present disclosure has a quality factor (Q) value improved by about 30%-40% when compared to a general-structure transverse electric and magnetic (TEM) mode resonator having the same size or has a physical size reduced by about 30%-40% when compared to the general structure TEM mode resonator having the same Q value.

Meanwhile, in the above-described structure according to the first embodiment of the present disclosure, a frequency of each resonance mode may be shifted and a resonance mode of a proper frequency may be set and adjusted by changing a shape, a length, and a width of the first through fourth resonance arms 211 through 214, a length and a width of the first through fourth resonance legs 221 through 224, a distance of the first through fourth resonance legs 221 through 224 with respect to the center of the cavity 200, and a size and a height of the cavity 200, and so forth. If necessary, only four or three resonance modes may be implemented.

Figure 5A:
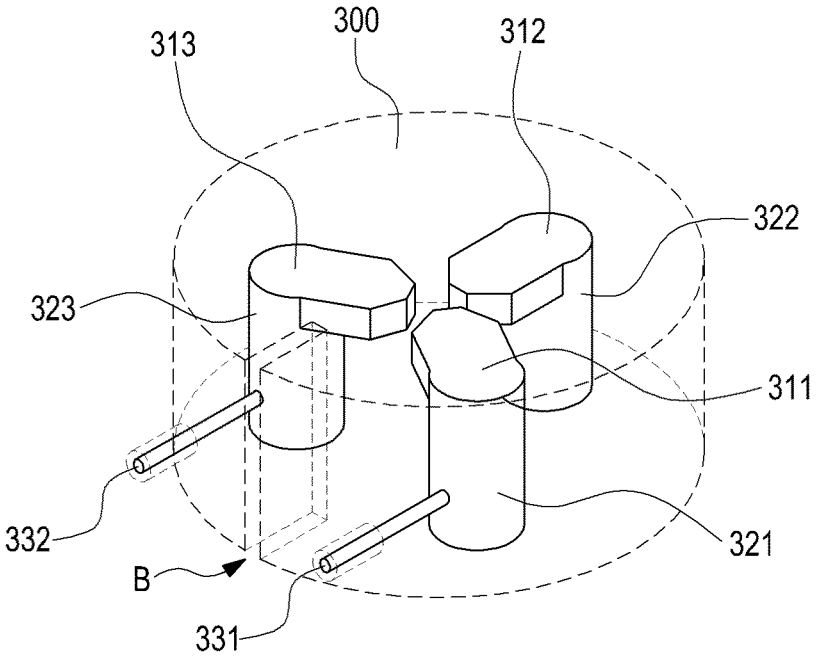
FIGS. 5A through 5C are structural diagrams of a multi-mode resonator corresponding to a bandpass filter according to a second embodiment of the present disclosure.
Figure 5B:
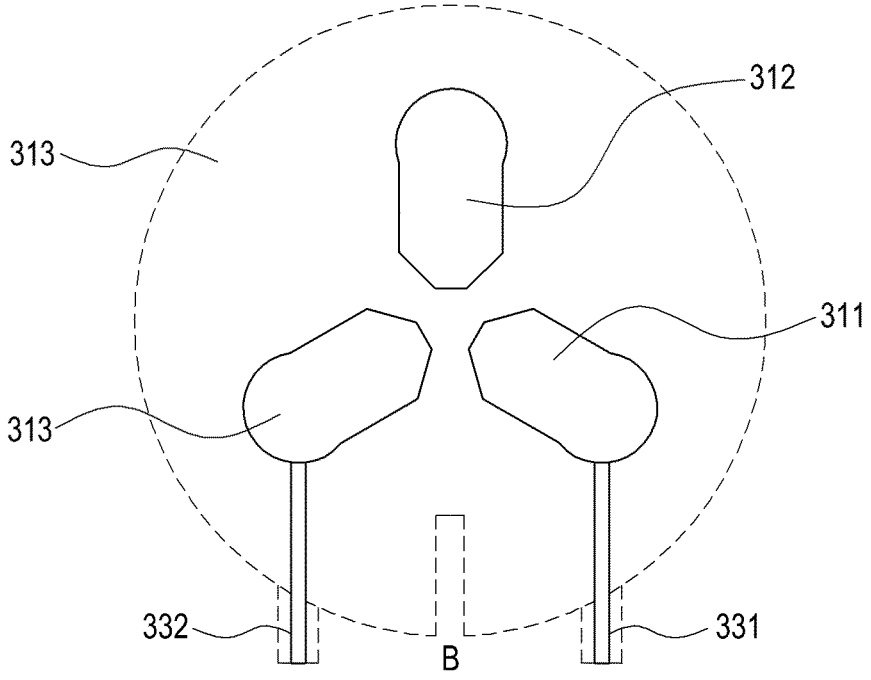
Figure 5C:
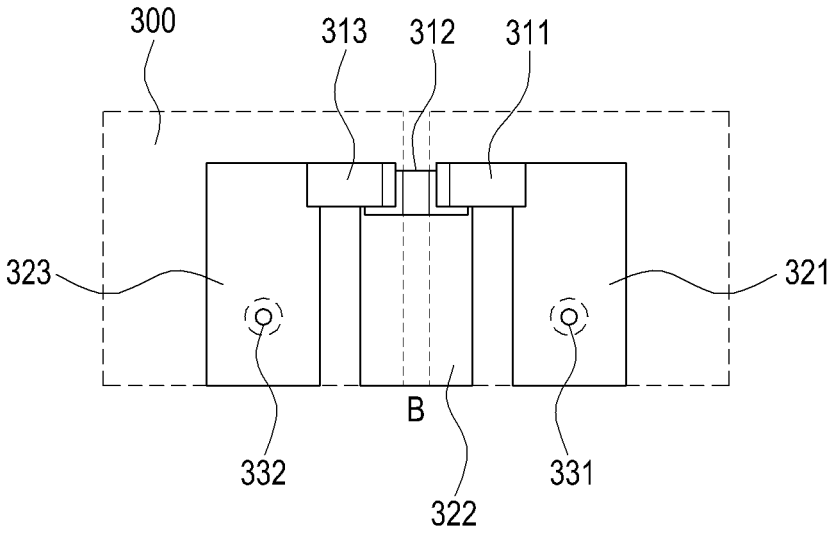

FIGS. 5A through 5C are structural diagrams of a multi-mode resonator corresponding to a bandpass filter according to a second embodiment of the present disclosure, in which FIG. 5A illustrates a partial perspective projection structure, FIG. 5B illustrates a top plan structure, and FIG. 5C illustrates a side structure. In FIGS. 5A through 5C, like in FIGS. 2A through 2C, a housing (not shown) forming a cavity 300 is not illustrated for convenience of a description.

Like the structure according to the first embodiment illustrated in FIGS. 2A through 2C, the resonator according to the second embodiment of the present disclosure illustrated in FIGS. 5A through 5C may include a housing (not shown) provided with the cavity 300 corresponding to a substantially single accommodation space, a plurality of resonance arms 311, 312, and 313 that are arranged with a preset interval therebetween in the cavity 300 and generate a resonant signal by multiple coupling therebetween, and a plurality of resonance legs 321, 322, and 323 that support the plurality of resonance arms 311, 312, and 313, respectively.

In the resonator according to the second embodiment structured as described above, unlike in the structure according to the first embodiment illustrated in FIGS. 2A through 2C, the cavity 300 is, for example, globally cylindrical in shape. The plurality of resonance arms 311, 312, and 313, which are a total of three first through third resonance arms 311, 312, and 313, are arranged with an equal interval therebetween. That is, as shown in the second embodiment illustrated in FIGS. 3A through 3C, in the cavity 200, the three resonance arms 311 through 313 in a bar shape are arranged such that one ends thereof are oriented toward the center of the cavity 300, and are arranged globally with an equal interval therebetween. The plurality of resonance legs 321 through 323, which are a total of three first through third resonance legs 321, 322, and 323, are installed to support the first through third resonance arms 311, 312, and 313, respectively. An input probe 331 and an output probe 332 are connected to the first resonance leg 321 and the third resonance leg 323, respectively.

The resonator according to the second embodiment illustrated in FIGS. 5A through 5C has a structure in which a resonance rod of the structure according to the first embodiment is removed (that is, is not provided). The structure of the resonator according to the second embodiment illustrated in FIGS. 5A through 5C is suitable for implementation of four or three resonance modes when compared to the structure of the first embodiment, and may provide quite satisfactory multi-mode characteristics.

In the resonator according to the second embodiment illustrated in FIGS. 5A through 5C, at least a part of corner portions of the three resonance arms 311 through 313 in a rectangular bar shape is cut by processing such as chamfering, etc., and with this structure change, characteristics such as coupling intensity, etc., are adjusted. In the example illustrated in FIGS. 5A through 5C, two parts of corner portions of each of facing ends of the three resonance arms 311, 312, and 313 are cut. In this way, through a change such as a cut structure of a corner of a resonance arm through chamfering, etc., the intensity of coupling between the resonance arms, generation of a notch, etc., may be adjusted.

In the structure according to the second embodiment, when compared to the structure according to the first embodiment, the first through third legs 321 through 323 are installed to be spaced apart from each other as far as possible. That is, the first through third resonance legs 321 through 323 are installed in such a way to support the first through third resonance arms 311 through 313, respectively, by being coupled with outer portions of the first through third resonance arms 311 through 313 with respect to the center of the cavity 300.

In this way, when the first through third resonance legs 321 through 323 are installed spaced further apart from each other, a similar effect to when a diameter of the entire structure of the first through third resonance legs 321 through 323 increases may be generated, leading to adjustment of a processing frequency band.

In the structure according to the second embodiment, in a proper position as well as between an input side of a signal and an output side of a signal like in a position B, a partition or a tuning screw may be further installed. Thus, perturbation may occur between resonance arms, thereby adjusting a transmission zero position, notch generation, and so forth.

As illustrated in FIGS. 2A through 2C and FIGS. 5A through 5C, the multi-mode resonator according to the first and second embodiments of the present disclosure may be structured, and various modifications or changes and applications may be made to the structures according to the first and second embodiments. For example, the resonance arms 211 through 214 or 311 through 314 may not have an identical length. For example, a length of one pair of the resonance arms may be set different from that of another pair of the resonance arms. Alternatively, there may be some differences in diameter, shape, and so forth. Such a structure is intended to change a transmission zero position in which the intensity and direction of fields coupled between the resonance arms are changed, thus adjusting a notch point. Likewise, designing may be performed such that differences exist in diameters, lengths, and so forth of the resonance legs 221 through 224 or 321 through 323. In this case, an interval between a resonance arm supported by a resonance leg and the cavity (200 or 300) may be increased or reduced, thus adjusting a capacitance component generated between the resonance arm and the cavity.

In addition, in the center of the entire structure of the resonance arms 211 through 214 or 311 through 314, a metallic coupling structure (not shown), which is installed to electrically float and has, for example, a cylindrical or disc shape, may be further provided for signal coupling between resonance arms and coupling adjustment between corresponding resonance modes. The coupling structure facilitates coupling between coupling resonance arms when compared to a case having no coupling structure, broadening the entire bandwidth of the filter. The coupling structure is fixed and supported by a support member (not shown) made of a material such as $Al_2O_3$, Teflon, etc., on an inner surface of the housing or cover or adjacent resonance arms in the cavity.

In the center of the entire structure of the resonance arms 211 through 214 or 311 through 314, a tuning screw (not shown) may be installed to pass through a cover, etc., from an upper end of the housing like in a conventional case. By using the tuning screw, signal coupling between resonance arms, coupling adjustment between corresponding resonance modes, and resonant frequency tuning may be performed.

The resonator according to the first embodiment or the resonator according to the second embodiment may also be formed dually. Alternatively, the resonators according to the first embodiment and the second embodiment may be coupled with each other. For example, a first resonator and a second resonator according to the first (or second) embodiment may be formed, and an output side of the first resonator and an input side of the second resonator may be connected to each other by a coupling window. In the coupling window, a conductive coupling structure structured properly to extend from, for example, the bottom surface of the cavity (i.e., the inner lower end surface of the housing), may also be installed to further facilitate coupling. Moreover, a resonator having a general single-mode structure may be coupled to the structure of the resonator according to the first (or second) embodiment.

Meanwhile, referring to the structures of the multi-mode resonator according to the first and second embodiments of the present disclosure illustrated in FIGS. 2A through 2C and FIGS. 5A through 5C, it can be seen that precise interval setting between the resonance arms 211 through 214 or 311 through 314 may be a crucial factor in characteristics of the multi-mode resonator. However, since in the first and second embodiments, the resonance arms 211 through 214 or 311 through 314 are fixedly installed in the resonance legs 221 through 224 or 321 through 323 by means of screw coupling, etc., an interval between the resonance arms 211 through 214 or 311 through 314 slightly deviates from a designed dimension due to an assembly tolerance.

Such an assembly tolerance is accumulated, exerting a significant influence upon the characteristics of the filter, and the assembly tolerance has a worse influence upon filtering characteristics especially when the filter is implemented to have a small size. Thus, after the filter is manufactured, frequency tuning has to be performed additionally. In general, frequency tuning is manually performed by a skilled operator using expensive tuning equipment, entailing a long working time and high working cost. Therefore, other embodiments of the present disclosure propose a resonator structure which reduces the assembly tolerance between parts to make frequency tuning simple and efficient and even requires no frequency tuning.

Figure 6A:
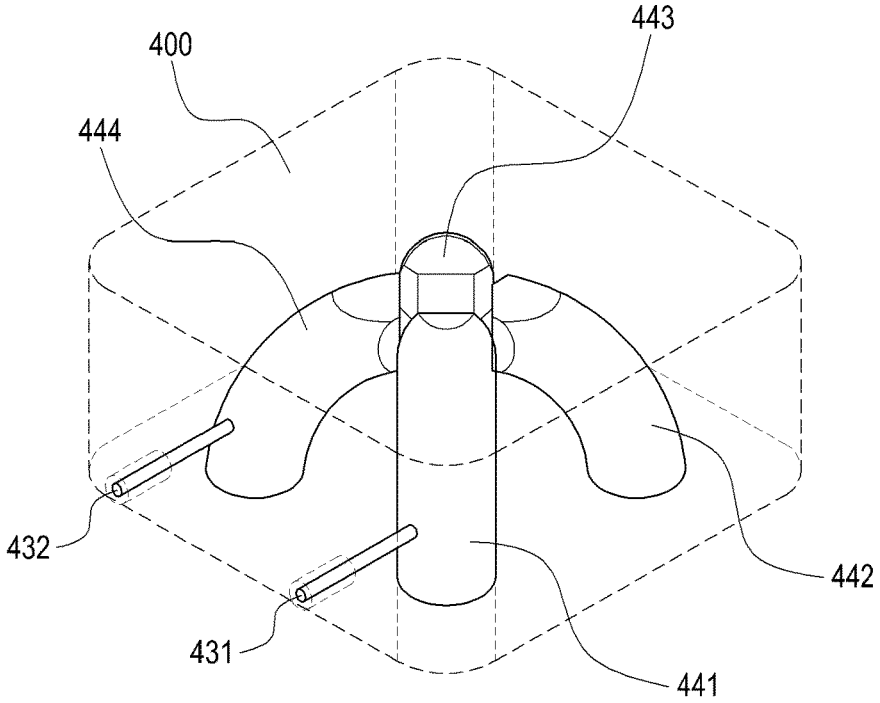
FIGS. 6A through 6D are structural diagrams of a multi-mode resonator corresponding to a bandpass filter according to a third embodiment of the present disclosure.
Figure 6B:
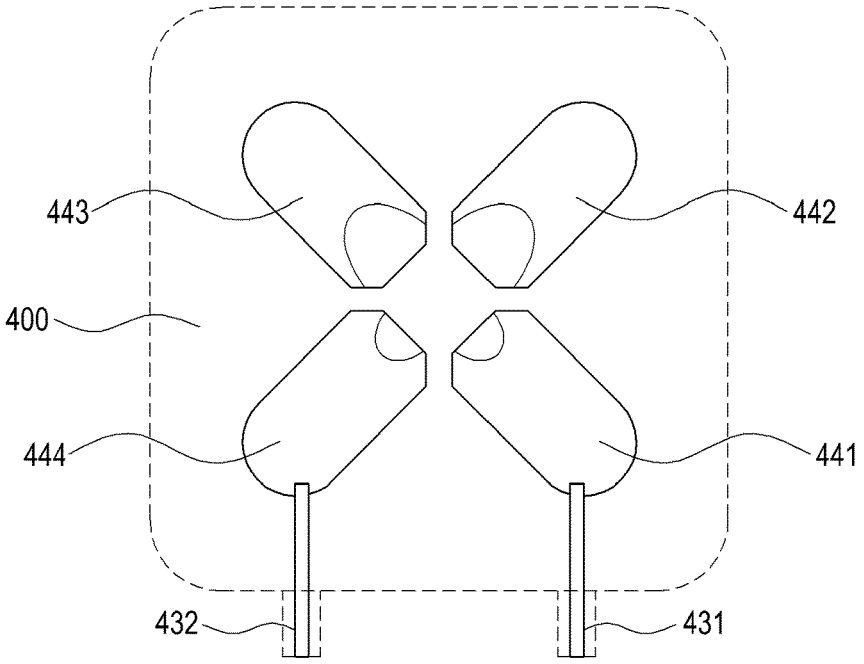
Figure 6C:
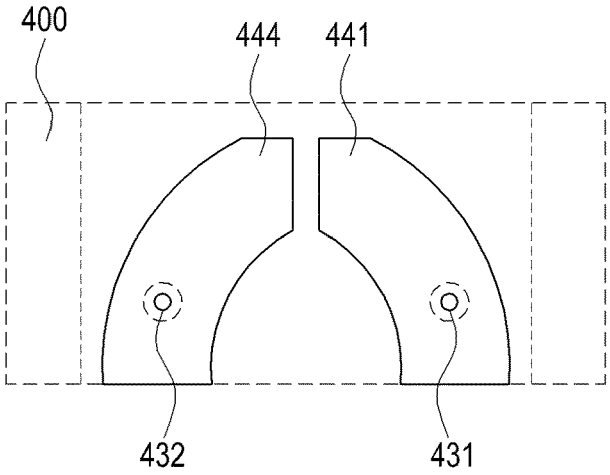
Figure 6D:
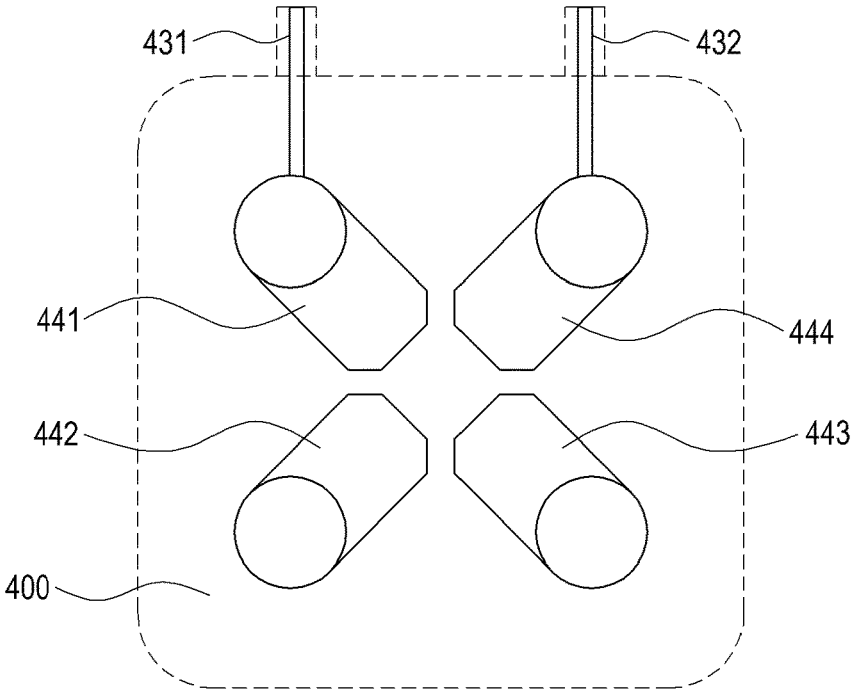

FIGS. 6A through 6D are structural diagrams of a multi-mode resonator corresponding to a bandpass filter according to a third embodiment of the present disclosure, in which FIG. 6A illustrates a perspective structure, FIG. 6B illustrates a top plan structure, FIG. 6C illustrates a side structure, and FIG. 6D illustrates a rear structure. Like a typical filter structure, the resonator according to the third embodiment of the present disclosure illustrated in FIGS. 6A through 6D may include a cavity 400 having a space formed by a metallic housing (a bottom cover). In FIGS. 6A through 6D, input and output connectors formed on an outer portion of the housing as well as the structure of the metallic housing are not illustrated for convenience of a description.

Referring to FIGS. 6A through 6D, the multi-mode resonator according to the third embodiment of the present disclosure includes the cavity 400 in a shape similar to a rectangular box, like in the first embodiment illustrated in FIGS. 2A through 2C. However, such a structure of the cavity 400 may have various shapes such as a polyprism, a cylinder, and so forth, as well as the rectangular box.

In the third embodiment according to the present disclosure illustrated in FIGS. 6A through 6D, unlike in the first and second embodiments where a plurality of resonance arms and a plurality of resonance legs are installed, a plurality of (e.g., four) resonance ribs 441, 442, 443, and 444 in an arch shape are arranged with a preset interval therebetween in the cavity 400, such that lower ends of the plurality of resonance ribs 441, 442, 443, and 444 are fixed on a bottom surface of the cavity 400 (i.e., an inner lower end surface of the housing) and upper ends thereof face each other, thereby generating resonant signals by multiple coupling therebetween. The four resonance ribs 441 through 444, that is, the first through fourth resonance ribs 441 through 444, are arranged globally (planarly) in the shape of 'x'. The arch shape of the resonance ribs 441 through 444 may be designed, for example, along a trajectory of a part of a circular arc.

An input probe 431 and an output probe 432 are connected to the first resonance rib 441 and the fourth resonance rib 444, respectively. Positions where the input probe 431 and the output probe 432 are installed may also affect magnetic fields (resonance characteristics) of the multi-mode resonator. Thus, the input probe 431 and the output probe 432 may be connected to arbitrary positions of the first through fourth ribs 441 through 444, depending on use conditions of the multi-mode resonator. For example, the input probe 431 may be connected to the third resonance rib 443, and the output probe 432 may be connected to the first resonance rib 441.

The resonance ribs 441 through 444 replace the plurality of resonance arms and the plurality of resonance legs in the first and second embodiments, and portions of the resonance ribs 441 through 444, which are fixed to the bottom surface of the cavity 400 (i.e., the inner lower end surface of the housing), serve as the resonance legs of the first and second embodiments and facing portions of the resonance ribs 441 through 444 serve as the resonance arms of the first and second embodiments. That is, the resonance ribs 441 through 444 are structured such that each of the plurality of resonance arms and each the plurality of resonance legs of the first and second embodiments are formed integrally with each other (to reduce the assembly tolerance).

However, in this case, each of the resonance ribs 441 through 444 has a bar shape that is bent globally in an arch shape, instead of having a shape in which a portion corresponding to a resonance arm and a portion corresponding to a resonance leg are separated as in the first and second embodiments. A cross-sectional shape of each of the resonance ribs 441 through 444 is substantially circular. In the present disclosure, it has been discovered that the filter may have quite satisfactory filtering characteristics through the resonance rib shaped as described above. Such a shape improves signal (current) flow by removal of an angled portion, thereby enhancing filtering characteristics. This shape provides an optimal structure that does not need a draft angle shape if the resonance rib is manufactured by die-casting, and does not need rounding (R) of corner portions of a product.

In the above-described structure according to the third embodiment of the present disclosure, by changing the shape, length, and width of the first through fourth resonance ribs 441 through 444, a frequency of each resonance mode may be shifted and a resonance mode of a proper frequency may be set and adjusted. In FIGS. 6A through 6D, the resonance ribs 441 through 444 have shapes in which a part of sides of corner portions of facing (upper) ends is cut by processing such as chamfering, etc., and, based on such a structure change, coupling intensity, notch generation, etc., may be adjusted.

In FIGS. 6A through 6D, the resonance ribs 441 through 444 have shapes in which a part of top portions of facing ends, i.e., upper ends is further cut, and with such a structure change, an interval and a coupling area between the resonance rib and the cavity 400 are adjusted, thereby adjusting a capacitance component generated between the resonance rib and the cavity 400. In this case, in FIGS. 6A through 6D, the cut top parts of the second resonance rib 442 and the third resonance rib 443 have been cut more than the cut top parts of the first resonance rib 441 and the fourth resonance rib 444.

Figure 7A:
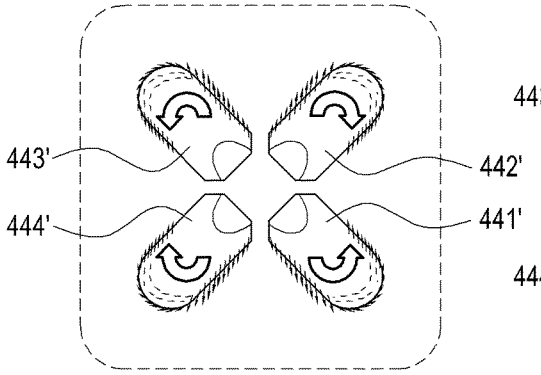
FIGS. 7A through 7D illustrate respective multi-mode resonance characteristics of a modified structure of the multi-mode resonator corresponding to the bandpass filter according to the third embodiment of the present disclosure.
Figure 7B:
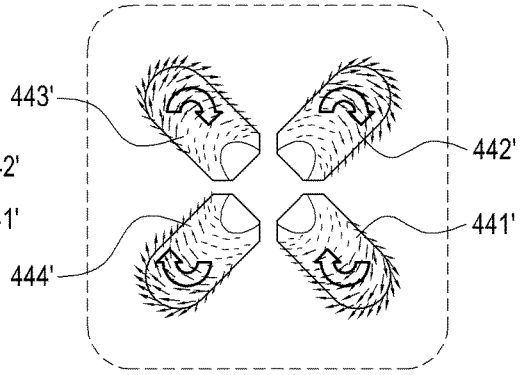

The multi-mode resonance characteristics of the resonator structured as described above according to the third embodiment of the present disclosure will be described with reference to FIGS. 7A through 7D and 8A through 8D. FIGS. 7A through 7D illustrate an example of multi-mode resonance characteristics of a modified structure of the multi-mode resonator corresponding to the bandpass filter according to the third embodiment of the present disclosure, in which multi-mode resonance characteristics are shown when cut parts of the resonance ribs 441 through 444 illustrated in FIGS. 6A through 6D have an identical structure (are symmetric to each other). FIGS. 7A and 7B show magnetic fields of the first resonance mode and the second resonance mode, formed by, for example, a combination of all of first through fourth resonance ribs 441' through 444', in which in FIG. 7A, the first resonance rib 441' and the third resonance rib 443' are paired to generate a magnetic field having the same polarity and the second resonance rib 442' and the fourth resonance rib 444' are paired to generate a magnetic field having the same polarity that is different from that of the first resonance rib 441' and the third resonance rib 443'. The magnetic fields may be globally combined (coupled) to form one resonance mode which has the minimum Q value among the four modes. FIG. 7B shows a case where the first through fourth resonance ribs 441' through 444' generate magnetic fields having the same polarity, which are globally combined to form one resonance mode having the maximum Q value among the four modes.

Figure 7C:
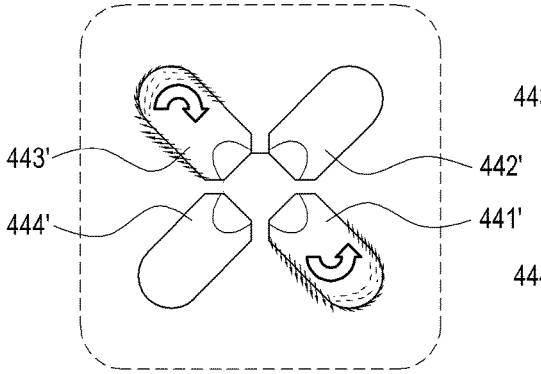
Figure 7D:
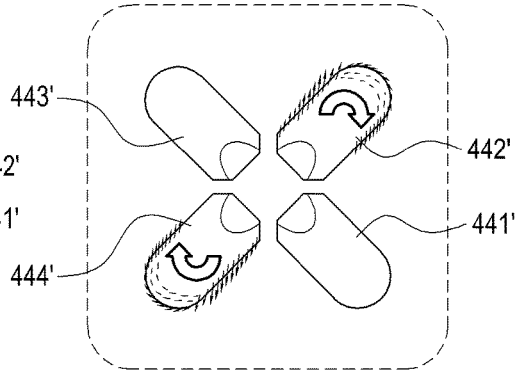

FIGS. 7C and 7D show magnetic fields of a third resonance mode and a fourth resonance mode formed by, for example, the pair of the first resonance rib 441' and the third resonance rib 443' and the pair of the second resonance rib 442' and the fourth resonance rib 444', respectively, in which FIG. 7C shows a resonance mode formed by a combination of magnetic fields having different polarities generated by the first resonance rib 441' and the third resonance rib 443', respectively. In this case, the resonance mode may have an intermediate Q value that is greater than that of the first resonance mode in FIG. 7A and is less than that of the second resonance mode in FIG. 7B. FIG. 7D shows a resonance mode formed by a combination of magnetic fields having different polarities generated by the second resonance rib 442' and the fourth resonance rib 444', respectively. In this case, the resonance mode may have a Q value that is similar to that in FIG. 7C.

Various magnetic field distributions between symmetric resonance ribs as shown in FIGS. 7A through 7D are possible by changing the intensity and direction of a magnetic field based on a change in physical setting values.

FIGS. 8A through 8D illustrate multi-mode resonance characteristics of a modified structure of the multi-mode resonator corresponding to the bandpass filter according to the third embodiment of the present disclosure, in which multi-mode resonance characteristics are shown when cut top parts of the resonance ribs 441 through 444 illustrated in FIGS. 6A through 6D are asymmetric to each other. That is, in FIGS. 8A through 8D, resonance mode characteristics are shown where the cut top parts of the second resonance rib 442 and the fourth resonance rib 444 are cut more than the cut top parts of the first resonance rib 441 and the third resonance rib 443.

Figure 8A:
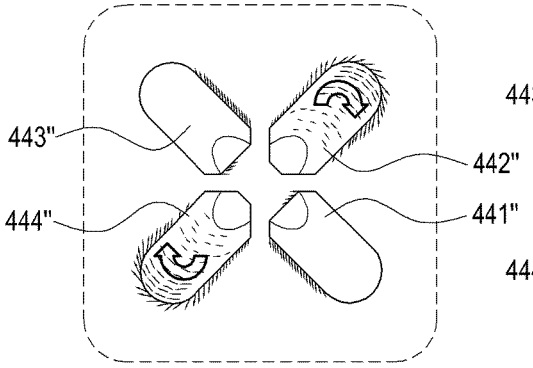
FIGS. 8A through 8D illustrate multi-mode resonance characteristics of another modified structure of the multi-mode resonator corresponding to the bandpass filter according to the third embodiment of the present disclosure.
Figure 8B:
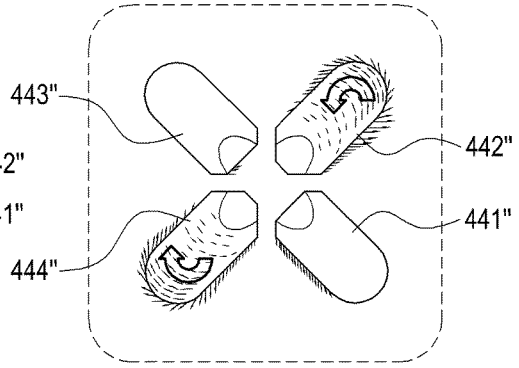

FIGS. 8A and 8B show magnetic fields of a first resonance mode and a second resonance mode formed by, for example, a pair of a second resonance rib 442" and a fourth resonance rib 444", in which FIG. 8A shows a resonance mode formed by a combination of magnetic fields having the same polarity generated by the second resonance rib 442" and the fourth resonance rib 444". FIG. 8B shows a resonance mode formed by a combination of magnetic fields having different polarities generated by the second resonance rib 442" and the fourth resonance rib 444".

Figure 8C:
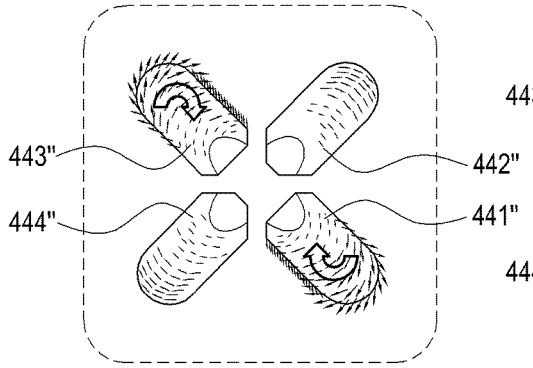
Figure 8D:
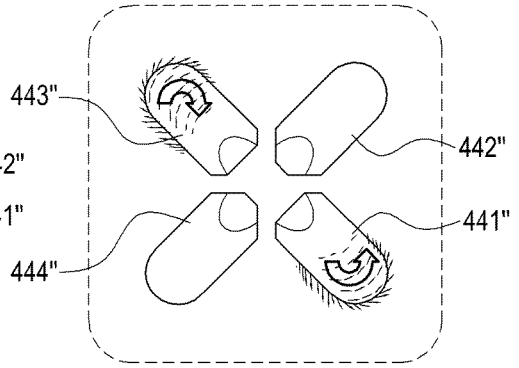

FIGS. 8C and 8D show magnetic fields of a third resonance mode and a fourth resonance mode formed by, for example, a pair of a first resonance rib 441" and a third resonance rib 443", in which FIG. 8C shows a resonance mode formed by a combination of magnetic fields having the same polarity generated by the first resonance rib 441" and the third resonance rib 443". FIG. 8D shows a resonance mode formed by a combination of magnetic fields having different polarities generated by the first resonance rib 441" and the third resonance rib 443".

Figure 9:
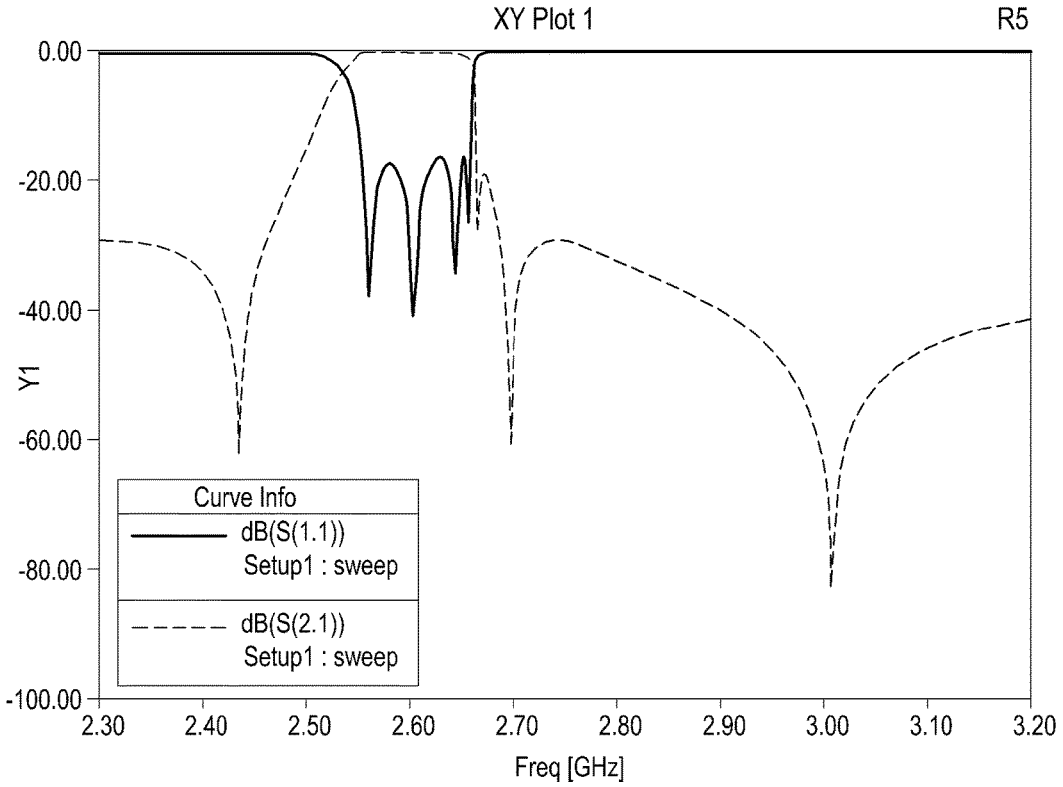
FIG. 9 is a graph showing frequency filtering characteristics of the multi-mode resonator corresponding to the bandpass filter according to the third embodiment of the present disclosure.

FIG. 9 is a graph showing frequency filtering characteristics of the multi-mode resonator corresponding to the bandpass filter according to the third embodiment of the present disclosure. Referring to FIG. 9, as shown in FIGS. 7A through 7D or in FIGS. 8A through 8D, frequency filtering characteristics vary with four multi-mode characteristics.

Figure 10A:
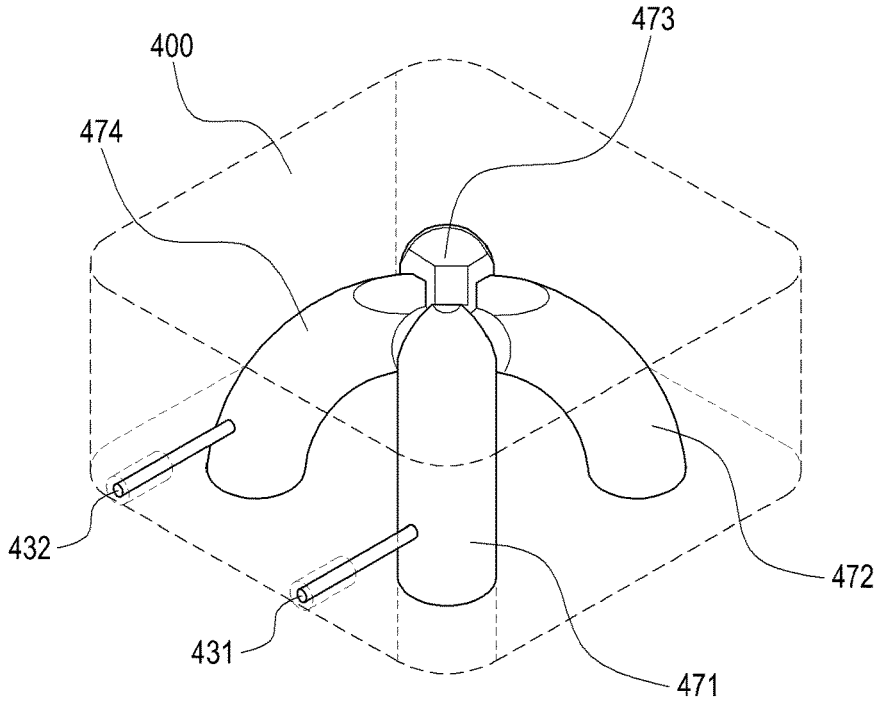
FIGS. 10A through 10D are structural diagrams of another modified structure of the multi-mode resonator corresponding to the bandpass filter according to the third embodiment of the present disclosure.
Figure 10B:
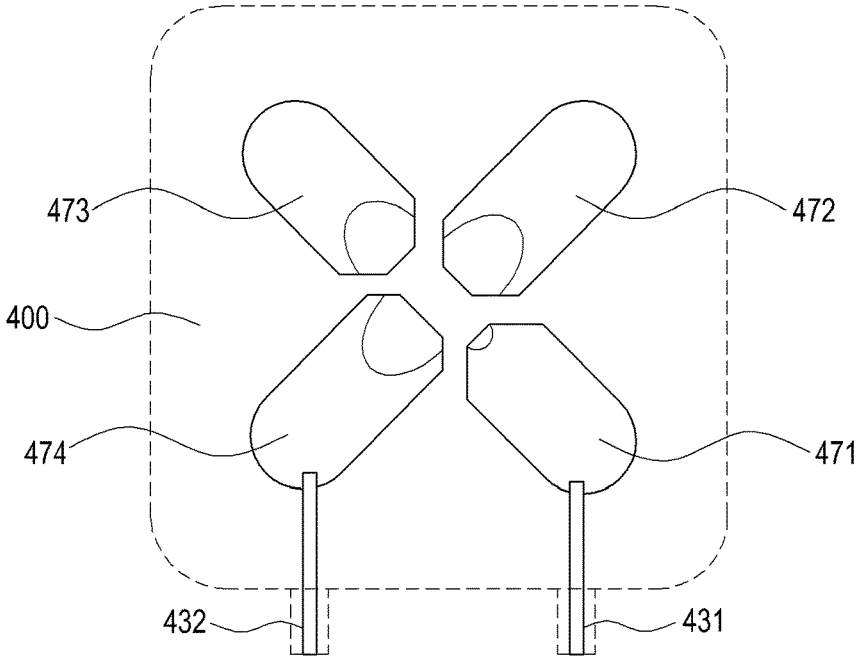
Figure 10C:
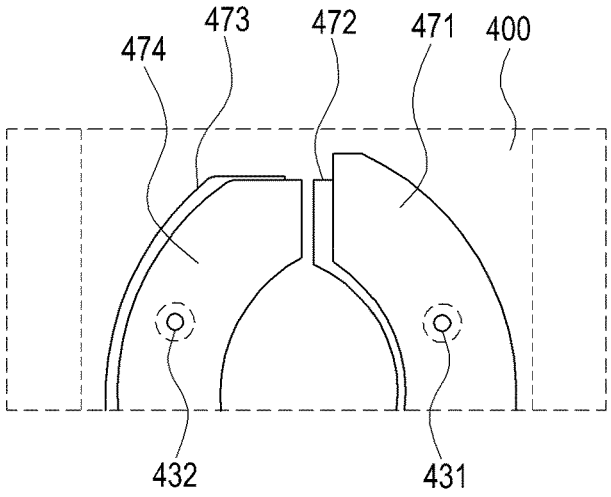
Figure 10D:
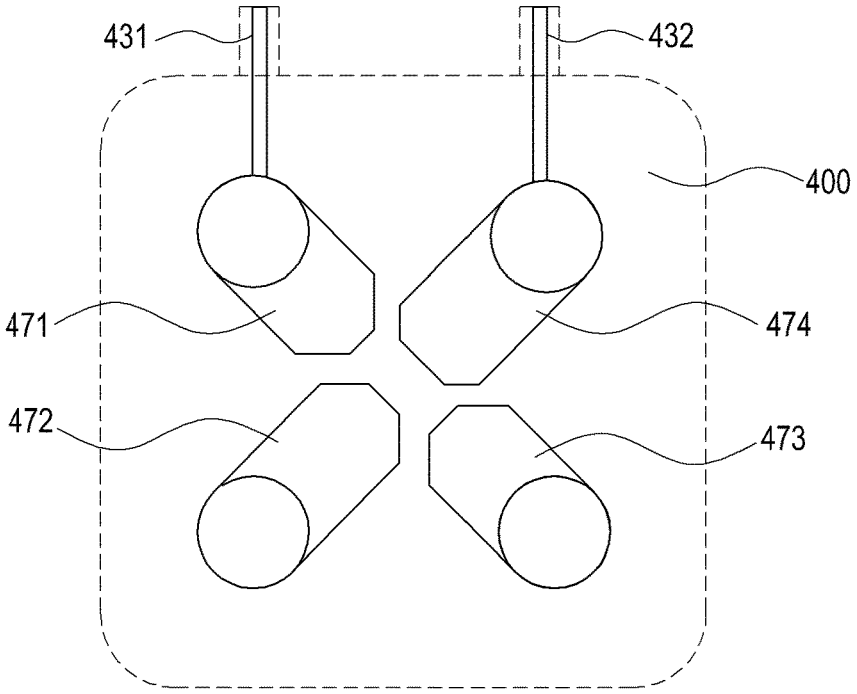
Figure 11A:
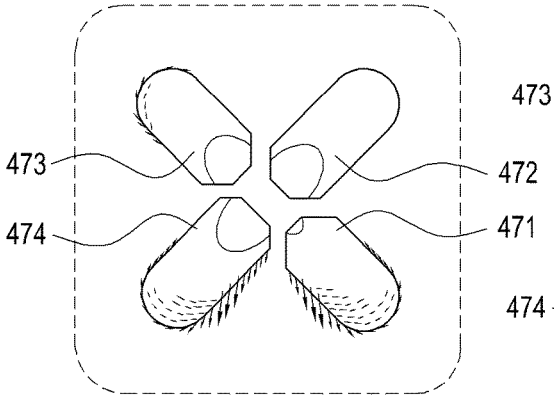
FIGS. 11A through 11D illustrate multi-mode resonance characteristics of the multi-mode resonator illustrated in FIGS. 10A through 10D.
Figure 11B:
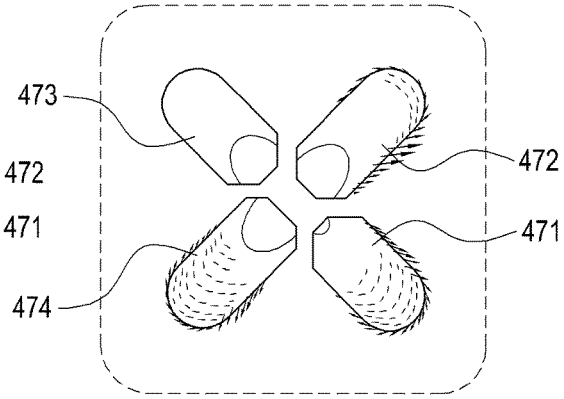
Figure 11C:
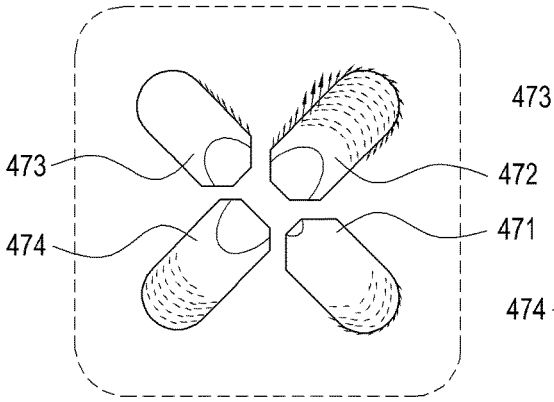
Figure 11D:
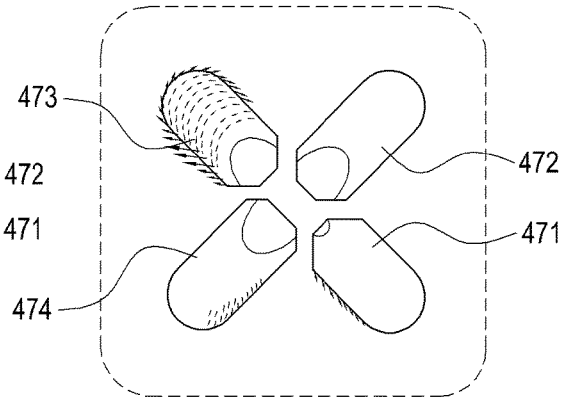

FIGS. 10A through 10D illustrate another modified structure of the multi-mode resonator corresponding to the bandpass filter according to the third embodiment of the present disclosure, in which FIG. 10A illustrates a perspective structure, FIG. 10B illustrates a top plan structure, FIG. 10C illustrates a side structure, and FIG. 10D illustrates a rear structure. As shown in FIGS. 6A through 6D, another modified structure of the resonator according to the third embodiment of the present disclosure illustrated in FIGS. 10A through 10D may include the cavity 400 having a space formed by a metallic housing. The modified structure may also include four (first through fourth) resonance ribs 471, 472, 473, and 474 in an arch shape which are arranged with a preset interval therebetween in the cavity 400. The input probe 431 and the output probe 432 are connected to the first resonance rib 471 and the fourth resonance rib 474, respectively.

In the resonator illustrated in FIGS. 10A through 10D, the resonance ribs 471 through 474 are designed to have slightly different (that is, asymmetric) shapes and sizes, instead of having the same (or symmetric) shapes and sizes, and cut top parts thereof are also slightly different from each other. In addition, installation intervals therebetween may have a slight difference. With such a structure, a position of a resonance mode may be properly changed and adjusted, changing the form of cross coupling and thus changing a transmission zero position.

In the example shown in FIGS. 10A through 10D, the second resonance rib 472 and the fourth resonance rib 474 have the same shape and size, but the first resonance rib 471 and the third resonance rib 473 have longer lengths (or higher heights) than the second resonance rib 472 and the fourth resonance rib 474, and especially, the first resonance rib 471 has the longest length (or the highest height). For example, if the arch shape of each of the resonance ribs 471 through 474 is designed along the trajectory of a part of a circular arc, the first resonance rib 471 may be designed such that an angle of the circular arc is greater than those of the other resonance ribs 472 through 474. The first resonance rib 471 has the smaller cut top part of an upper end thereof than the other resonance ribs 472 through 474. FIGS. 11A through 11D illustrate multi-mode resonance characteristics of the multi-mode resonator illustrated in FIGS. 10A through 10D, in which FIGS. 11A through 11D show first through fourth resonance modes formed by magnetic fields generated by proper combinations of all of or some selected pairs of the resonance ribs 471 through 474, respectively.

Figure 12:
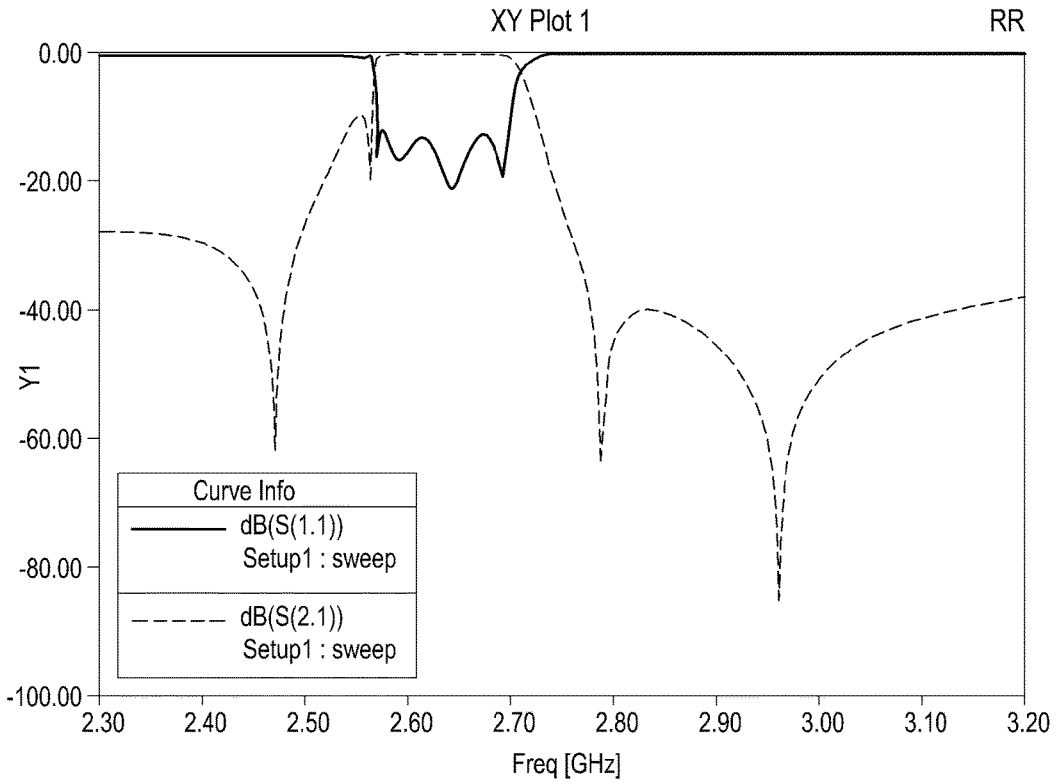
FIG. 12 illustrates frequency filtering characteristics of the multi-mode resonator illustrated in FIGS. 10A through 10D.

FIG. 12 is a graph showing frequency filtering characteristics of the multi-mode resonator illustrated in FIGS. 10A through 10D, and referring to FIG. 12, as shown in FIGS. 11A through 11D, frequency filtering characteristics vary with the four multi-mode characteristics.

Meanwhile, in the multi-mode resonator according to the third embodiment of the present disclosure as illustrated in FIGS. 6A through 6D or the modified structures thereof, each of the four resonance ribs 441 through 444 may be fixedly installed on the bottom surface of the cavity 400 (or the inner lower end surface of the housing) by means of welding, soldering, screw-coupling, or the like. However, such a way to install the resonance ribs 441 through 444 may have an assembly tolerance therebetween, and thus other embodiments of the present disclosure propose a resonator structure capable of further reducing the assembly tolerance of the resonance ribs 441 through 444.

Figure 13A:
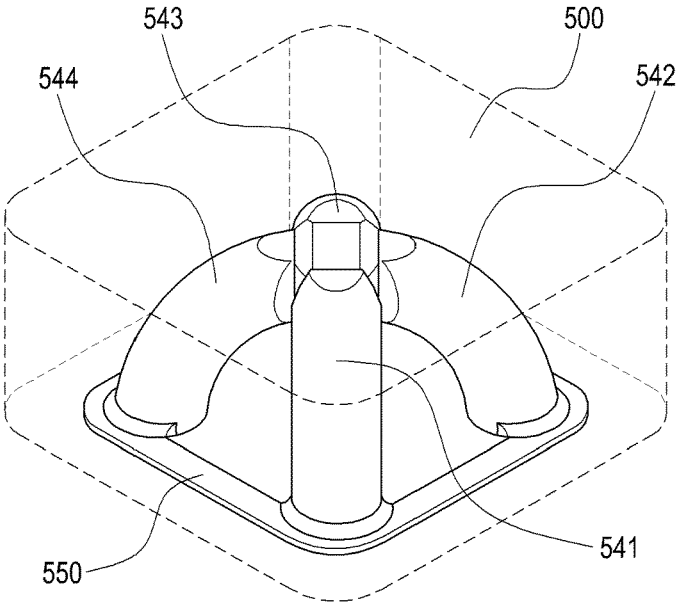
FIGS. 13A through 13D are structural diagrams of a multi-mode resonator corresponding to a bandpass filter according to a fourth embodiment of the present disclosure.
Figure 13B:
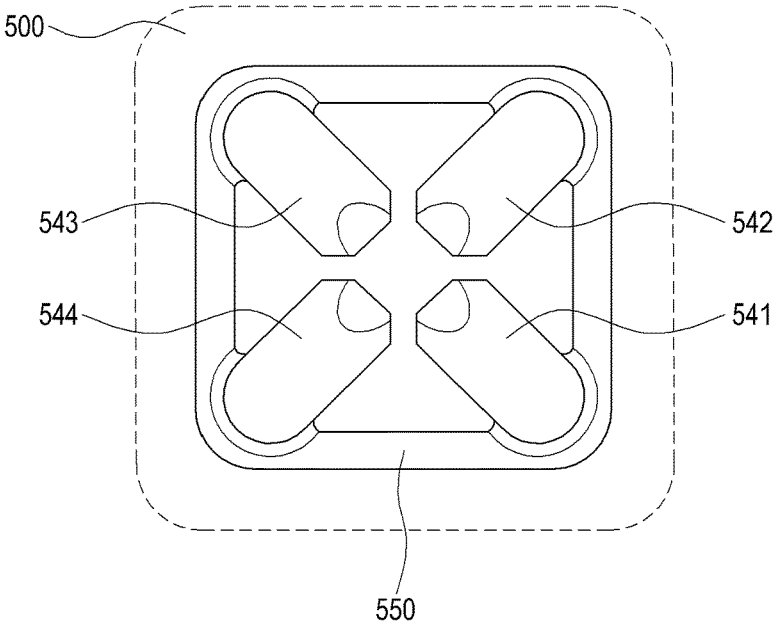
Figure 13C:
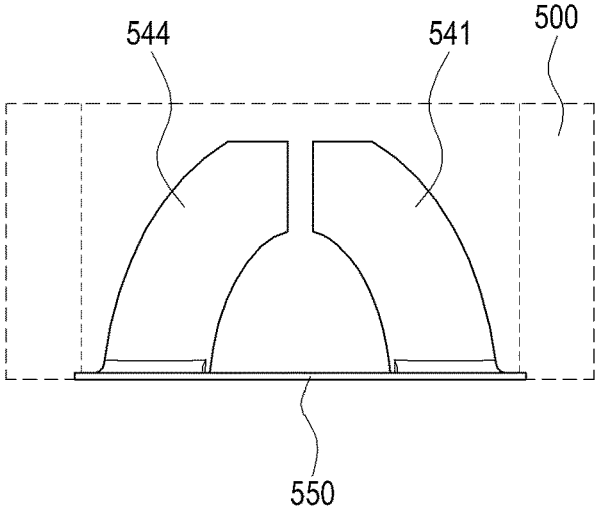
Figure 13D:
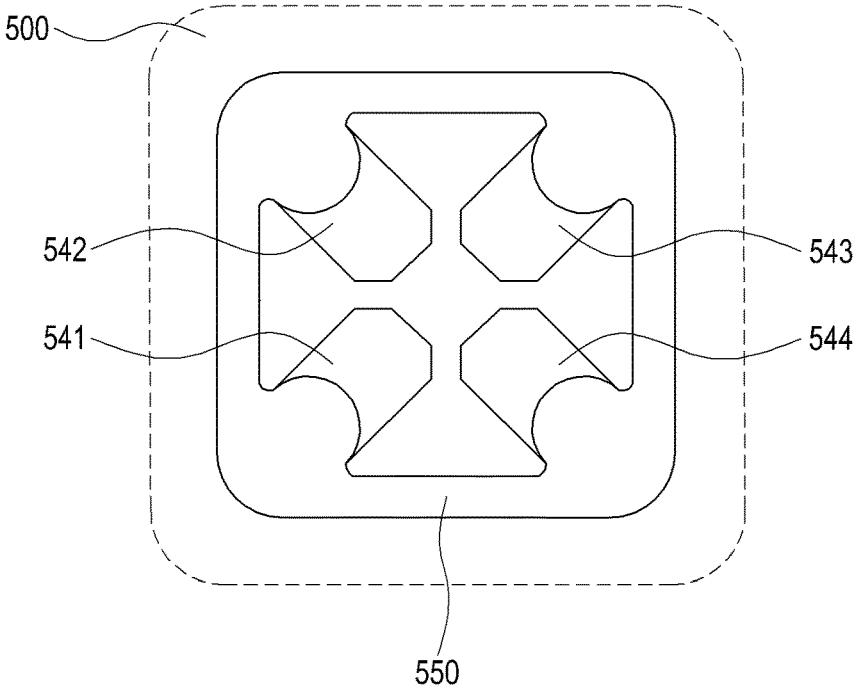

FIGS. 13A through 13D are structural diagrams of a multi-mode resonator corresponding to a bandpass filter according to a fourth embodiment of the present disclosure, in which FIG. 13A illustrates a perspective structure, FIG. 13B illustrates a top plan structure, FIG. 13C illustrates a side structure, and FIG. 13D illustrates a rear structure. The resonator according to the fourth embodiment of the present disclosure illustrated in FIGS. 13A through 13D, unlike in the third embodiment illustrated in FIGS. 6A through 6D, may include a cavity 500 that is similar in shape with a rectangular box and a plurality of (e.g., four) resonance ribs 541, 542, 543, and 544 in an arch shape, which are arranged with a preset interval therebetween in the cavity 500, such that lower ends of the plurality of resonance ribs 541, 542, 543, and 544 are fixed on a bottom surface of the cavity 500 (i.e., the inner lower end surface of the housing) and upper ends thereof face each other, thereby generating resonant signals by multiple coupling therebetween.

However, in the fourth embodiment of the present disclosure, unlike in the third embodiment, the lower ends of the resonance ribs 541 through 544 are globally connected integrally by a connecting auxiliary support 550 having, for example, a rectangular ring shape. In other words, the entire structure of the resonance ribs 541 through 544 together with the connecting auxiliary support 550 may be manufactured integrally, for example, by single die-casting. Such a structure may reduce the assembly tolerance because the installation interval between the resonance ribs 541 through 544 is fixed to a designed state (the optimal state).

Figure 14A:
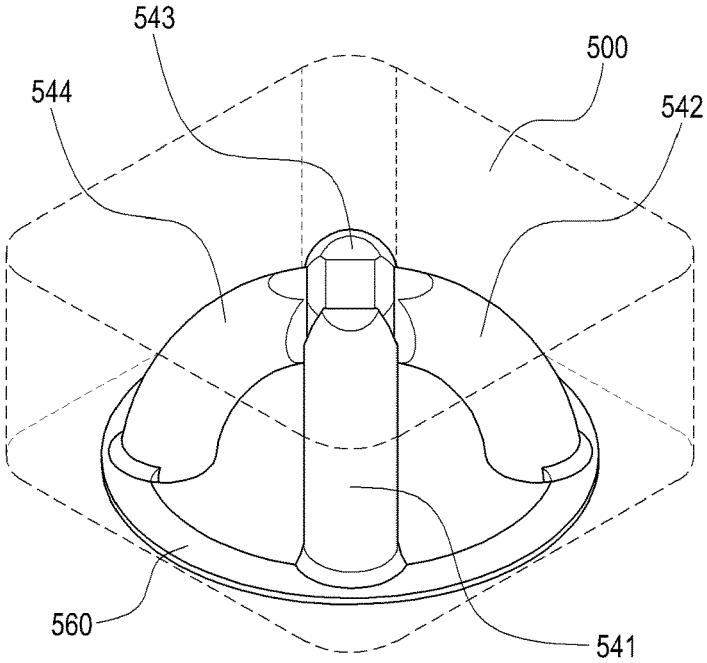
FIGS. 14A through 14D are structural diagrams of a modified structure of the multi-mode resonator corresponding to the bandpass filter according to the fourth embodiment of the present disclosure.
Figure 14B:
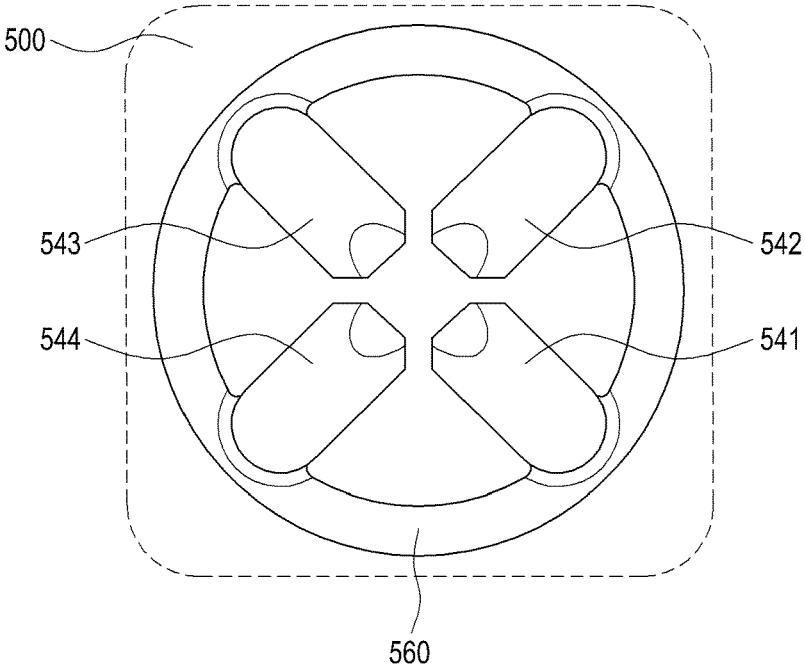
Figure 14C:
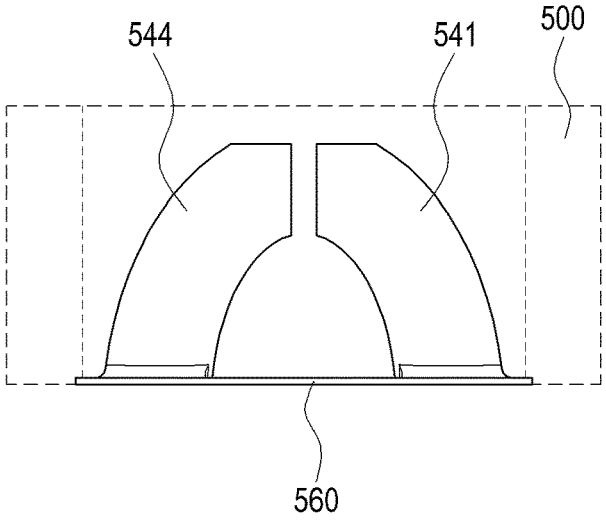
Figure 14D:
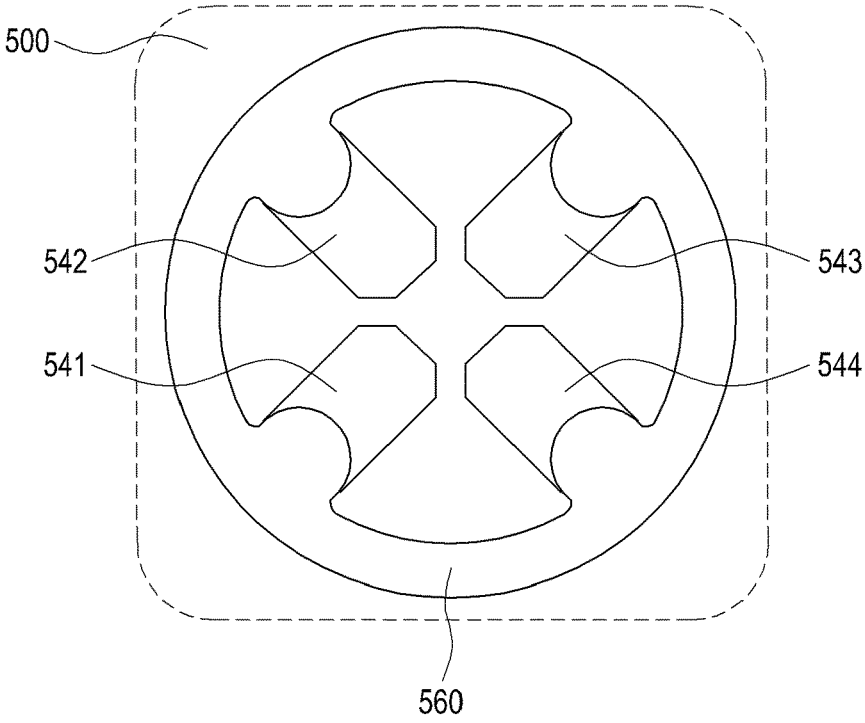

FIGS. 14A through 14D are structural diagrams of a modified structure of the multi-mode resonator according to the fourth embodiment of the present disclosure illustrated in FIGS. 13A through 13D, in which FIG. 14A illustrates a perspective structure, FIG. 14B illustrates a top plan structure, FIG. 14C illustrates a side structure, and FIG. 14D illustrates a rear structure. The modified structure of the resonator according to the fourth embodiment illustrated in FIGS. 14A through 14D is the same as the resonator according to the fourth embodiment except that an auxiliary support 560 connecting the lower ends of the resonance ribs 541 through 544 is circular in shape.

Meanwhile, in the multi-mode resonator according to the fourth embodiment of the present disclosure as illustrated in FIGS. 13A through 13D or in FIGS. 14A through 14D, the four resonance ribs 541 through 544 are integrally manufactured by the auxiliary support 550 or 560 and then are fixedly installed on the bottom surface of the cavity 500 (or the inner lower end surface of the housing) by means of welding, soldering, screw-coupling, or the like. However, such a way to install the resonance ribs 541 through 444 may have an assembly tolerance in assembling with the housing, and thus other embodiments of the present disclosure propose a structure capable of further reducing the assembly tolerance of the resonance ribs 541 through 444.

Figure 15A:
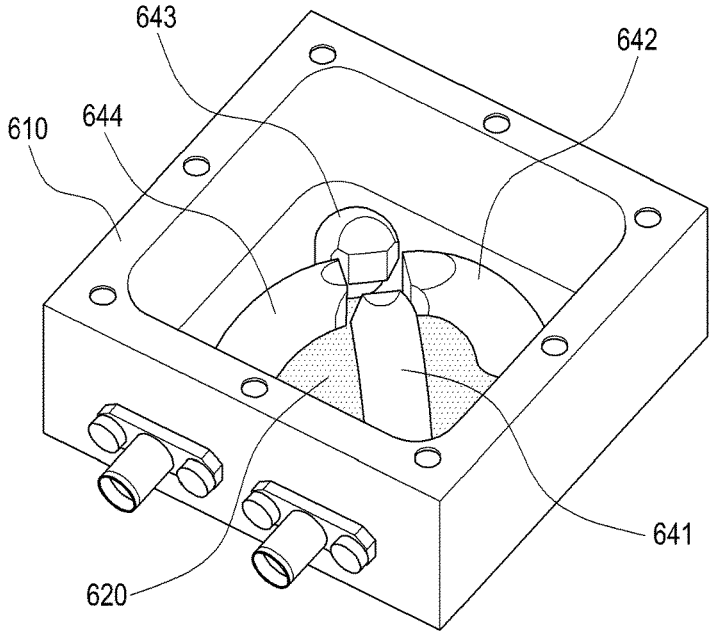
FIGS. 15A through 15D are structural diagrams of a multi-mode resonator corresponding to a bandpass filter according to a fifth embodiment of the present disclosure.
Figure 15B:
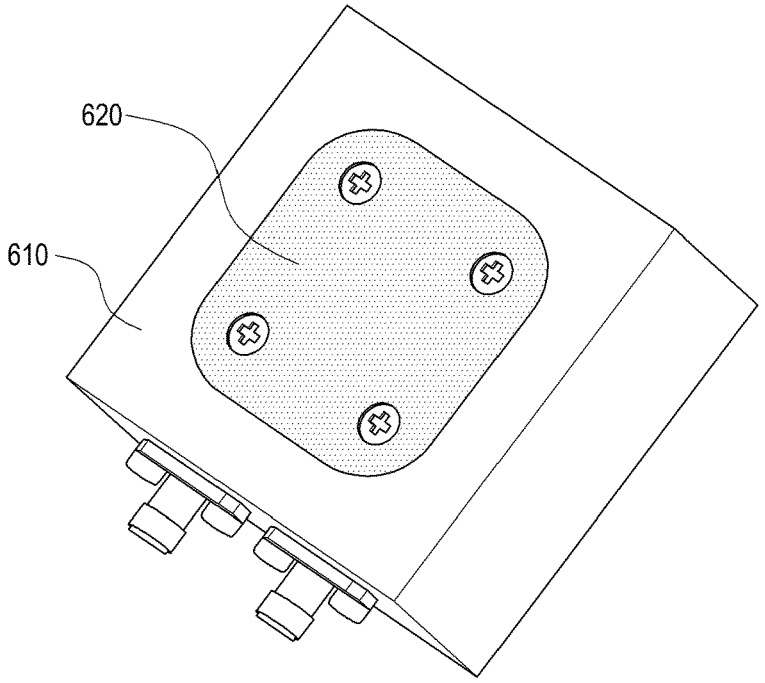
Figure 15C:
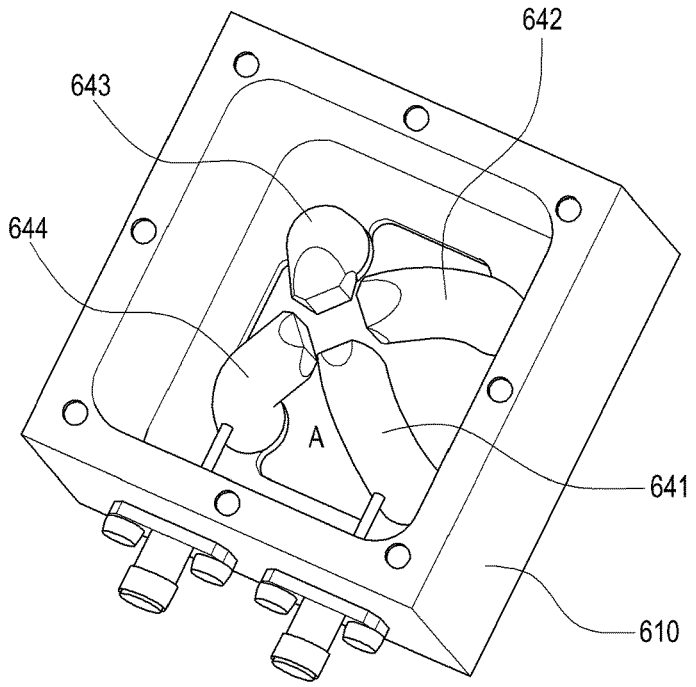
Figure 15D:
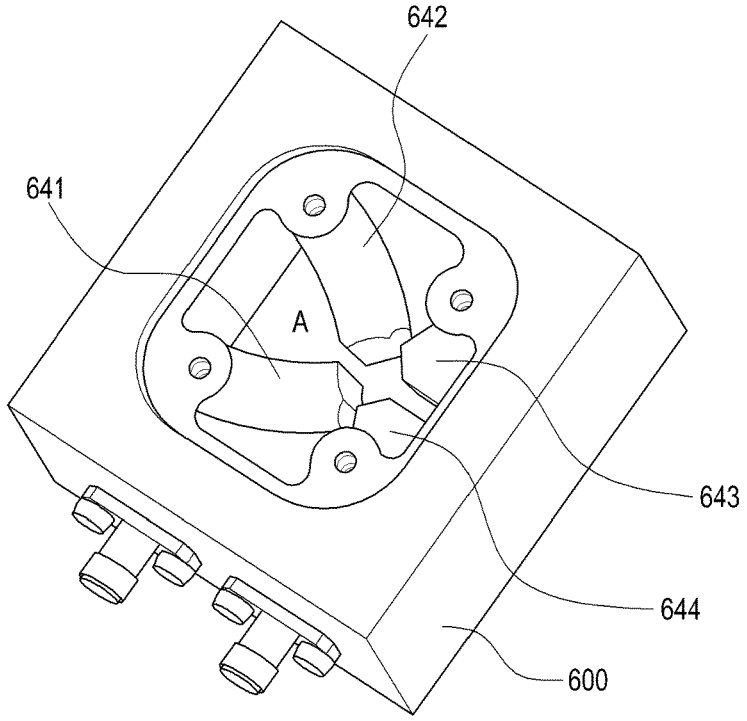

FIGS. 15A through 15D are structural diagrams of a multi-mode resonator corresponding to a bandpass filter according to a fifth embodiment of the present disclosure, in which FIGS. 15A and 15C illustrates a perspective structure of an upper side, and FIGS. 15B and 15D illustrate a perspective view of a lower side. FIGS. 15C and 15D show a structure in which a closure 620 is removed. The resonator according to the fifth embodiment of the present disclosure illustrated in FIGS. 15A through 15D, like in the third embodiment illustrated in FIGS. 6A through 6D, may include a cavity formed by a housing 600 to be similar in shape with a rectangular box and four resonance ribs 641, 642, 643, and 644 in an arch shape, which are arranged with a preset interval therebetween in the housing 600, such that lower ends of the plurality of resonance ribs 641, 642, 643, and 644 are fixed on the housing 600 and upper ends thereof face each other, thereby generating resonant signals by multiple coupling therebetween.

However, in the fifth embodiment of the present disclosure, unlike in the third embodiment, the lower ends of the resonance ribs 641 through 644 are manufactured in such a way to extend from the bottom surface of the housing 600, that is, to be globally integrally with the housing 600 when the housing 600 is manufactured. In other words, the entire structure of the housing 600 and the resonance ribs 641 through 644 may be manufactured integrally, for example, by single die-casting. During die-casting, to allow separation of a product (i.e., the housing and the resonance ribs formed integrally with the housing) from a mold, as indicated by A in FIGS. 15C and 15D, a hole portion having proper area and shape is formed on the bottom surface of the housing 600. The hole portion A is stopped by the closure 620 made of the same material as the housing 600. The closure 620 has a shape corresponding to the hole portion A of the housing 600 and thus may be fixedly installed in the hole portion A by means of welding, soldering, screw-coupling, or the like.

The resonator according to the fourth or fifth embodiment illustrated in FIGS. 13A through 13D, FIGS. 14A through 14D, and FIGS. 15A through 15D, like various modified structures of the third embodiment, may also have various modified structures to shift a frequency of a resonance mode and to set and adjust a resonance mode of a proper frequency by changing the shape, length, and width of the resonance ribs, adjusting an installation interval between the resonance ribs, and so forth.

Figure 16A:
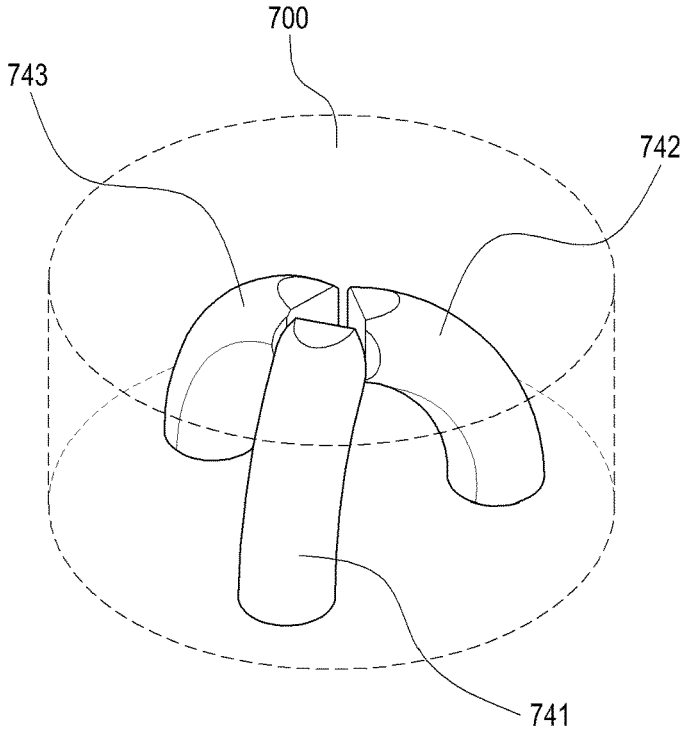
FIGS. 16A through 16C are structural diagrams of a multi-mode resonator corresponding to a bandpass filter according to a sixth embodiment of the present disclosure.
Figure 16B:
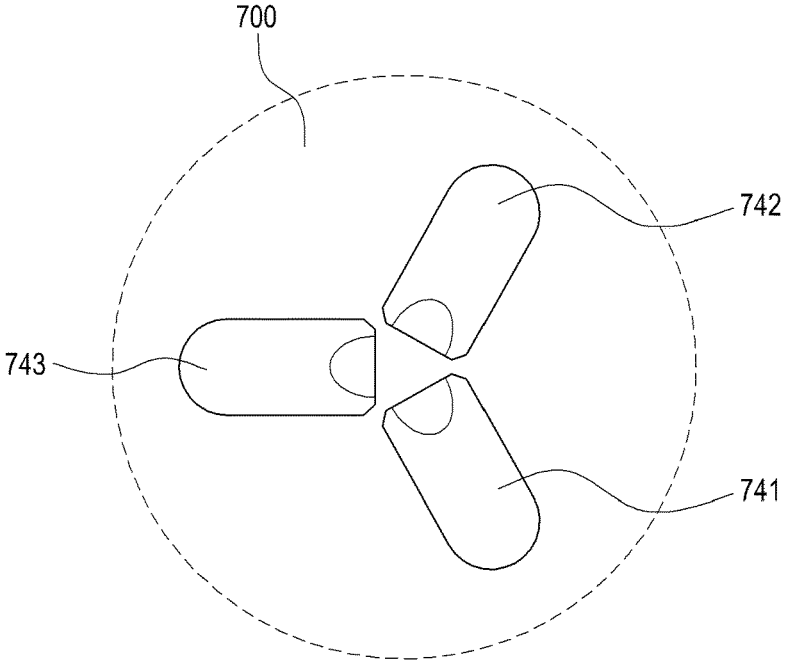
Figure 16C:
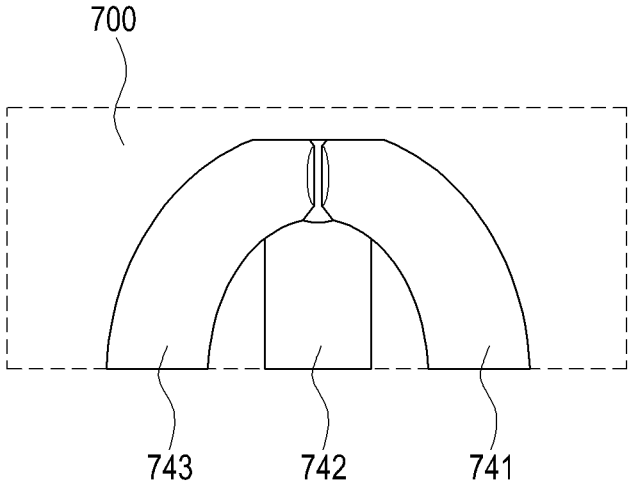

FIGS. 16A through 16C are structural diagrams of a multi-mode resonator corresponding to a bandpass filter according to a sixth embodiment of the present disclosure, in which FIG. 16A illustrates a perspective structure, FIG. 16B illustrates a top plan structure, and FIG. 16C illustrates a side structure. A structure of the multi-mode resonator according to the sixth embodiment of the present disclosure illustrated in FIGS. 16A through 16C, like the structure according to the third embodiment illustrated in FIGS. 6A through 6D, may include a cavity 700 having a space formed by a metallic housing. The structure may also include a plurality of resonance ribs 741, 742, and 743 arranged with a preset interval therebetween in the cavity 700.

In the resonator according to the sixth embodiment illustrated in FIGS. 16A through 16C, unlike in the structure according to the third embodiment illustrated in FIGS. 6A through 6D, the cavity 700 has, for example, a globally cylindrical shape. The plurality of resonance arms 741, 742, and 743, which are a total of three first through third resonance arms 741, 742, and 743, are arranged with an equal interval therebetween. The structure of the resonator according to the sixth embodiment illustrated in FIGS. 16A through 16C is suitable for implementation of three resonance modes when compared to the structure of the fourth embodiment, and may provide quite satisfactory multi-mode characteristics.

Figure 17A:
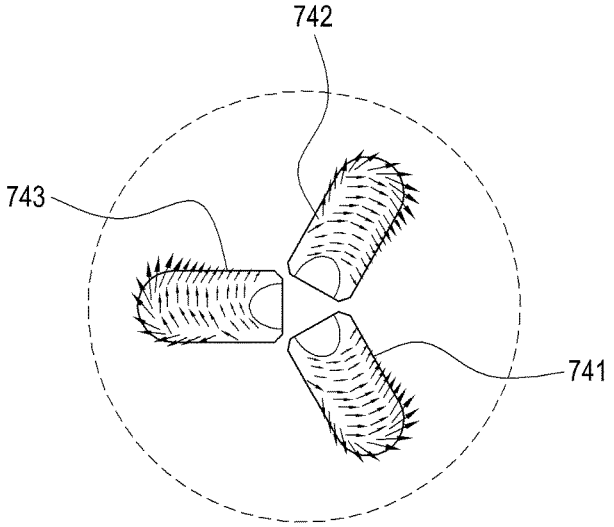
FIGS. 17A through 17C illustrate multi-mode resonance characteristics of the multi-mode resonator corresponding to the bandpass filter according to the sixth embodiment of the present disclosure.
Figure 17B:
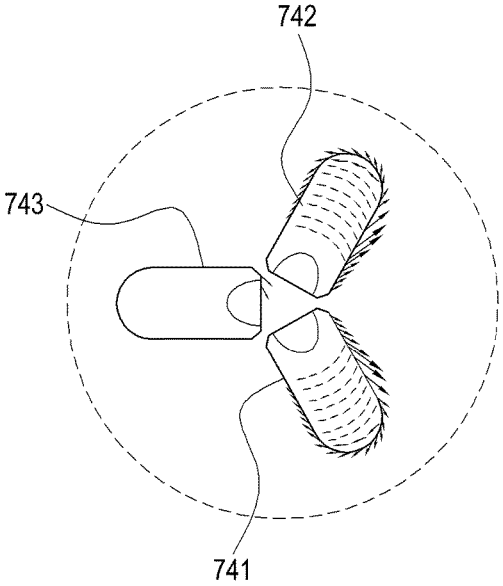
Figure 17C:
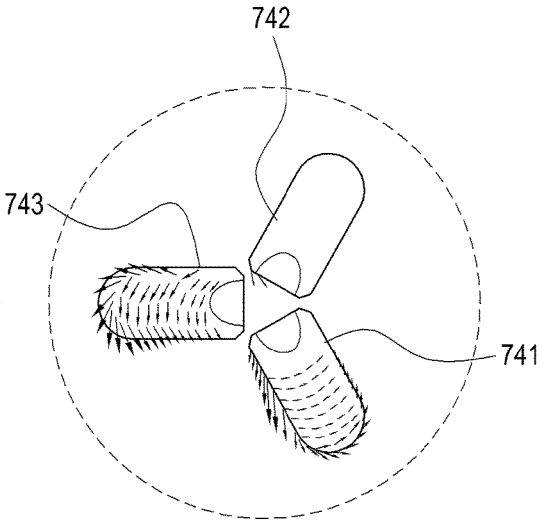

FIGS. 17A through 17C illustrate multi-mode resonance characteristics of the multi-mode resonator according to the sixth embodiment of the present disclosure, in which FIGS. 17A through 17C show first through third resonance modes formed by magnetic fields generated by proper combinations of all of or some selected pairs of the resonance ribs 741 through 743, respectively. For example, FIG. 17A shows a first resonance mode formed by a combination of all of the first through third resonance ribs 741 through 743, FIG. 17B shows a second resonance mode formed by a combination of a pair of the first resonance rib 741 and the second resonance rib 742, and FIG. 17C shows a third resonance mode formed by a combination of the first resonance rib 741 and the third resonance rib 743. As illustrated in FIGS. 17A through 17C, the multi-mode resonator according to the sixth embodiment of the present disclosure generates three resonance modes.

Figure 18A:
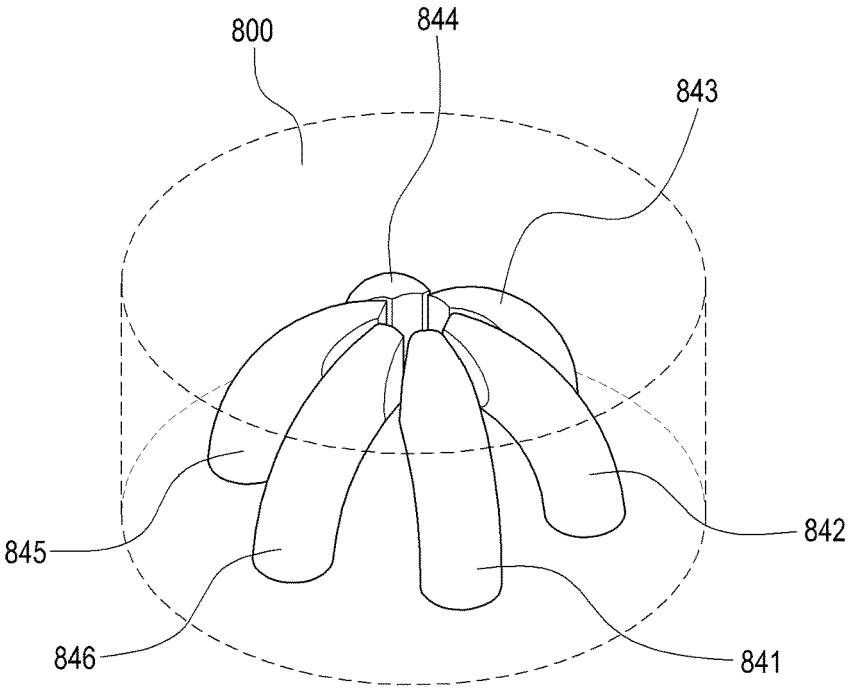
FIGS. 18A through 18C are structural diagrams of a multi-mode resonator corresponding to a bandpass filter according to a seventh embodiment of the present disclosure.
Figure 18B:
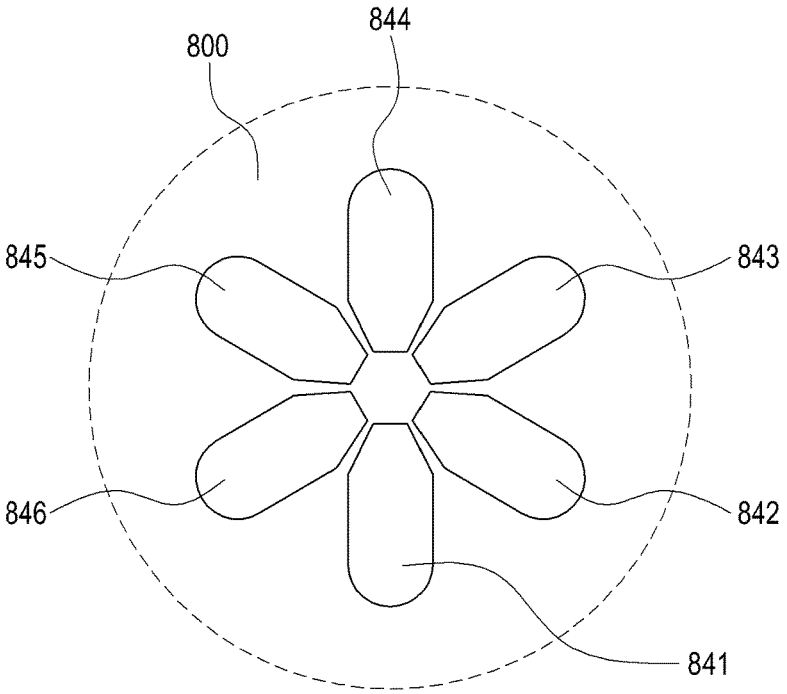
Figure 18C:
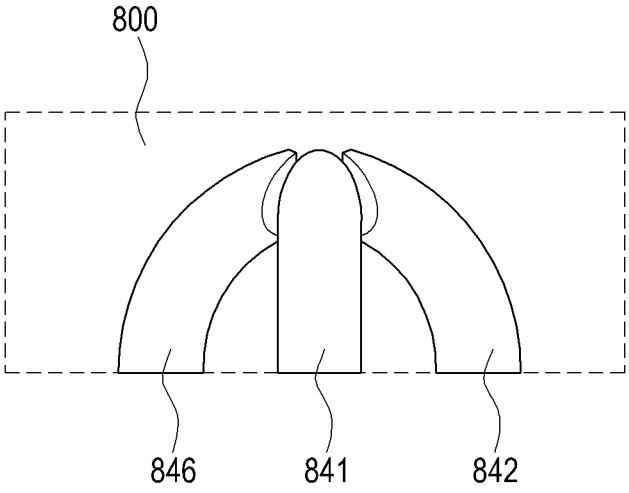

FIGS. 18A through 18C are structural diagrams of a multi-mode resonator corresponding to a bandpass filter according to a seventh embodiment of the present disclosure, in which FIG. 18A illustrates a perspective structure, FIG. 18B illustrates a top plan structure, and FIG. 18C illustrates a side structure. The structure of the resonator according to the seventh embodiment of the present disclosure illustrated in FIGS. 18A through 18C, like the structure of the sixth embodiment illustrated in FIGS. 16A through 16C, may include a cavity 800 having a space formed by a metallic housing and a plurality of resonance ribs 841, 842, 843, 844, 845, and 846 arranged with a preset interval therebetween in the cavity 800.

However, in the resonator according to the seventh embodiment illustrated in FIGS. 18A through 18C, the plurality of resonance ribs 841 through 846, which are a total of six first through sixth resonance ribs 841 through 846, are arranged with an equal interval therebetween. The structure of the resonator according to the seventh embodiment illustrated in FIGS. 18A through 18C is suitable for implementation of six resonance modes and may provide quite satisfactory multi-mode characteristics.

Meanwhile, the resonator according to the sixth or seventh embodiment illustrated in FIGS. 16A through 16C and FIGS. 18A through 18C, like various modified structures of the third embodiment, may also have various modified structures to shift a frequency of a resonance mode and to set and adjust a resonance mode of a proper frequency by changing the shape, length, and width of the resonance ribs, adjusting an installation interval between the resonance ribs, and so forth. Like in the fourth or fifth embodiment, the resonance ribs may be manufactured integrally with each other or integrally with the housing. In this case, even when a number of resonance ribs are installed as in the structure according to the seventh embodiment illustrated in FIGS. 18A through 18C, an additional separate operation is not required in manufacturing to integrally form the resonance ribs by single die-casting.

The multi-mode resonator according to an embodiment of the present disclosure may be structured as described above, and while detailed embodiments have been described in the description of the present disclosure, various modifications may be made without departing from the scope of the present disclosure. For example, although the number of resonance arms or resonance ribs is 3, 4, or 6 in the foregoing embodiments, a more number of resonance arms may be installed in one cavity.

In addition, a filter structure may be designed by dually connecting two or more structures of the above-described multi-mode resonator overlappingly, and similarly, by connecting three or more structures in three or more stages to obtain desired characteristics.

The structure according to the third and fourth embodiments may further include a partition, a coupling structure, and so forth like in the first and second embodiments or the modified structure thereof Moreover, the structure according to the third and fourth embodiments has small (or little) assembly tolerance when compared to the structure according to the first and second embodiments, but may further include a tuning screw for more precise frequency tuning like in a conventional filter structure.

As described above, a multi-mode resonator according to various embodiments of the present disclosure may provide resonant frequencies in multiple modes to a single resonator. Thus, the size, weight, and manufacturing cost of the filter may be reduced. Moreover, in the multi-mode resonator according to various embodiments of the present disclosure, an assembly tolerance between parts is hardly generated, making frequency tuning of the filter simple and efficient.

As such, various modifications and changes may be made to the present disclosure, and thus the scope of the present disclosure should be defined by the appended claims and equivalents thereof, rather than by the described embodiments.

What is claimed is:

1. A resonator comprising:

a housing having a cavity therein; and a plurality of resonance ribs which are arranged radially around a center of the cavity with a predetermined interval therebetween, wherein each of the plurality of resonance ribs comprises a body having a lower end and an upper end, wherein the lower end of each of the plurality of resonance ribs is fixed to a bottom surface of the housing, and the body of the each of the plurality of resonance ribs is bent so that the upper end of each of the plurality of resonance ribs points to the center of the cavity.

2. The resonator of claim 1, wherein the body of each of the plurality of resonance ribs is cylinder-shaped which is bent to be an arch shape.

3. The resonator of claim 2, wherein a cross-section of the body of each of the plurality of resonance ribs is substantially circular.

4. The resonator of claim 1, wherein at least a part of the upper end of the plurality of resonance ribs is cut to form a flat surface.

5. The resonator of claim 4, wherein the lower ends of the plurality of resonance ribs are generally integrally connected by a single connecting auxiliary support having a ring shape.

6. The resonator of claim 1, further comprising a cover which covers the cavity, and a tuning screw installed at the center of the cavity to penetrate the cover into the cavity.

7. The resonator of claim 1, wherein the plurality of resonance ribs are arranged with an equal interval therebetween.

8. The resonator of claim 1, wherein the housing is cylinder-shaped.

9. The resonator of claim 1, wherein at least one of the plurality of resonance ribs has a different length.

10. The resonator of claim 1, wherein at least one of the plurality of resonance ribs has a different height from the bottom surface.

11. A resonator, comprising:

a housing having a cavity therein; and a first resonance rib and a second resonance rib which are arranged in an opposite direction to each other around a center of the cavity, wherein each of the first resonance rib and the second resonance rib comprises a body having a lower end and an upper end, wherein the lower end of each of the first resonance rib and the second resonance rib is fixed to a bottom surface of the housing, and the body of each of the first resonance rib and the second resonance rib is bent so that the upper end of each of the first resonance rib and the second resonance rib points to the center of the cavity.

12. The resonator of claim 11, wherein the body of each of the first resonance rib and the second resonance rib is cylinder-shaped which is bent to be an arch shape.

13. The resonator of claim 12, wherein a cross-section of the body of each of the first resonance rib and the second resonance rib is substantially circular.

14. The resonator of claim 11, wherein at least a part of the upper end of the first resonance rib and the second resonance rib is cut to form a flat surface.

15. The resonator of claim 14, wherein the lower ends of the first resonance rib and the second resonance rib are generally integrally connected by a single connecting auxiliary support having a ring shape.

16. The resonator of claim 11, further comprising a cover which covers the cavity, and a tuning screw installed at the center of the cavity to penetrate the cover into the cavity.

17. The resonator of claim 11, further comprising a third resonance rib which comprises a body having a lower end and an upper end, the lower end of each of the first resonance rib and the second resonance rib is fixed to a bottom surface of the housing, and the body of each of the first resonance rib and the second resonance rib is bent so that the upper end of each of the first resonance rib and the second resonance rib points to the center of the cavity wherein the lower end of the third resonance rib is fixed to the bottom surface of the housing, and the body of the third resonance rib is bent so that the upper end of the third resonance rib points to the center of the cavity, wherein the first, second and third resonance ribs are arranged with an equal interval therebetween.

18. The resonator of claim 11, wherein the housing is cylinder-shaped.

19. The resonator of claim 11, wherein a length of the first resonance rib is different from a length of the second resonance rib.

20. The resonator of claim 11, wherein a height of the first resonance rib is different from a height of the second resonance rib from the bottom surface.

* * * * *